US007363898B2

(12) United States Patent
Suzuki et al.

(10) Patent No.: US 7,363,898 B2
(45) Date of Patent: Apr. 29, 2008

(54) VALVE TIMING CONTROL DEVICE

(75) Inventors: Shigemitsu Suzuki, Takahama (JP); Naoto Toma, Kariya (JP); Takeshi Hashizume, Aichi-gun (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 11/643,873

(22) Filed: Dec. 22, 2006

(65) Prior Publication Data

US 2007/0144475 A1 Jun. 28, 2007

(30) Foreign Application Priority Data

Dec. 27, 2005 (JP) ..... 2005-375614
Apr. 27, 2006 (JP) ..... 2006-123302

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,976,460 B2 * 12/2005 Komazawa et al. ..... 123/90.15

FOREIGN PATENT DOCUMENTS

JP 2004-116412 A 4/2004

* cited by examiner

*Primary Examiner*—Thomas Denion
*Assistant Examiner*—Zelalem Eshete
(74) *Attorney, Agent, or Firm*—Buchanan Ingersoll & Rooney PC

(57) ABSTRACT

A valve timing control device includes a driving side rotational member synchronously rotatable with a crankshaft of an internal combustion engine, a driven side rotational member synchronously rotatable with a camshaft that controls an opening and closing operation of valves of the internal combustion engine, a retarded angle chamber, an advanced angle chamber, a fluid supply and discharge mechanism, a lock mechanism for locking the relative rotational phase at a predetermined lock phase, a phase displacement restriction mechanism switching the relative rotational phase between a restricted state and an unrestricted state, the phase displacement restriction mechanism includes a recess portion and an insertion member so as to achieve the restricted state and the unrestricted state, and a retention mechanism for retaining the phase displacement restriction mechanism in the unrestricted state in which the insertion member is retracted from the recess portion.

7 Claims, 20 Drawing Sheets

VALVE TIMING CONTROL DEVICE

CROSS REFERENCE TO RELATED APPLICATIONS

This application is based on and claims priority under 35 U.S.C. § 119 to Japanese Patent Application Nos. 2005-375614 and 2006-123302, filed on Dec. 27, 2005 and Apr. 27, 2006, respectively, the entire content of which is incorporated herein by reference.

FIELD OF THE INVENTION

This invention generally relates to a valve timing control device.

BACKGROUND

A known valve timing control device includes a driving side rotational member synchronously rotatable with a crankshaft of an internal combustion engine, a driven side rotational member arranged coaxially with the driving side rotational member and synchronously rotatable with a camshaft that controls an opening and closing operation of valves of the internal combustion engine, a retarded angle chamber defmed by the driving side rotational member and the driven side rotational member and displacing a relative rotational phase of the driven side rotational member to the driving side rotational member in a retarded angle direction by a supply of a fluid to the retarded angle chamber, an advanced angle chamber defmed by the driving side rotational member and the driven side rotational member and displacing the relative rotational phase in an advanced angle direction by the supply of the fluid to the advanced angle chamber, a fluid supply and discharge mechanism for supplying the fluid to the advanced angle chamber and the retarded angle chamber and for discharging the fluid from the advanced angle chamber and the retarded angle chamber, and a lock mechanism for locking the relative rotational phase at a predetermined lock phase.

The aforementioned valve timing control device, which is used in an internal combustion engine such as an automobile engine, controls the opening and closing timing of the valves by displacing the relative rotational phase of the driven side rotational phase to the driving side rotational phase so that the internal combustion engine can be appropriately operated. In addition, the valve timing control device locks the relative rotational phase at the predetermined lock phase in which an appropriate opening and closing timing of the valves can be obtained when starting the internal combustion engine.

Such valve timing control device is disclosed in JP2004-116412A. The valve timing control device disclosed includes a lock mechanism constituted by a recess portion formed at a driven side rotational member and two lock members formed at a driving side rotational member. The two lock members are inserted into the recess portion for achieving a locked state or retracted from the recess portion for achieving an unlocked state, and are constantly biased in a direction so that the lock members are inserted into the recess portion. According to the valve timing control device disclosed, when the two lock members are inserted into the recess portion so as to achieve the locked state, one of the lock members prevents displacement of the relative rotational phase of the driven side rotational member to the driving side rotational member in the retarded angle direction while the other one of the lock members prevents displacement of the relative rotational phase in the advanced angle direction. Then, by a supply of a portion of a fluid provided to the retarded angle chamber to the recess portion, the two lock members are retracted therefrom so as to achieve the unlocked state.

When or immediately after the internal combustion engine starts operating, the relative rotational phase should be locked at a phase different from the predetermined lock phase. However, according to the aforementioned valve timing control device, the relative rotation can be only locked at the single predetermined lock phase and may not be locked at the different phase. Immediately after the internal combustion engine starts operating, for example, the relative rotation should be locked at the phase different from the predetermined lock phase so as to reduce occurrence of hydrocarbon (i.e. cold HC). In addition, at the operation start of the internal combustion engine, an optimum opening and closing timing of the valve is not constant and may vary depending on a state of the internal mechanism such as a temperature of a combustion chamber. Accordingly, in order to obtain the optimum opening and closing timing of the valves when starting of the internal combustion engine, the relative rotation should be locked at the phase different from the predetermined lock phase.

Thus, a need exists for a valve timing control device that can lock a relative rotational phase between a driving side rotational member and a driven side rotational member at a phase different from a predetermined lock phase when or immediately after an internal combustion engine starts operating.

SUMMARY OF THE INVENTION

According to an aspect of the present invention, a valve timing control device includes a driving side rotational member synchronously rotatable with a crankshaft of an internal combustion engine, a driven side rotational member arranged coaxially with the driving side rotational member and synchronously rotatable with a camshaft that controls an opening and closing operation of valves of the internal combustion engine, a retarded angle chamber defmed by the driving side rotational member and the driven side rotational member and displacing a relative rotational phase of the driven side rotational member to the driving side rotational member in a retarded angle direction by a supply of a fluid to the retarded angle chamber, an advanced angle chamber defined by the driving side rotational member and the driven side rotational member and displacing the relative rotational phase in an advanced angle direction by the supply of the fluid to the advanced angle chamber, a fluid supply and discharge mechanism for supplying the fluid to the advanced angle chamber and the retarded angle chamber and for discharging the fluid from the advanced angle chamber and the retarded angle chamber, a lock mechanism for locking the relative rotational phase at a predetermined lock phase, and a phase displacement restriction mechanism operable separately from the lock mechanism and switching the relative rotational phase between a restricted state in which a displacement of the relative rotational phase is restricted within a predetermined phase displacement allowable range and an unrestricted state in which the restricted state is released. The phase displacement restriction mechanism includes a recess portion and an insertion member inserted into the recess portion so as to achieve the restricted state and retraced from the recess portion so as to achieve the unrestricted state, the recess portion provided at one of the driving side rotational member and the driven side rotational member, the insertion member provided at the other one of the driving side rotational member and the driven side rotational member, the insertion member biased to be inserted into the recess portion. The valve timing control device further includes a retention mechanism for retaining the phase displacement restriction mechanism in the unrestricted state in which the insertion member is retracted from the recess portion.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
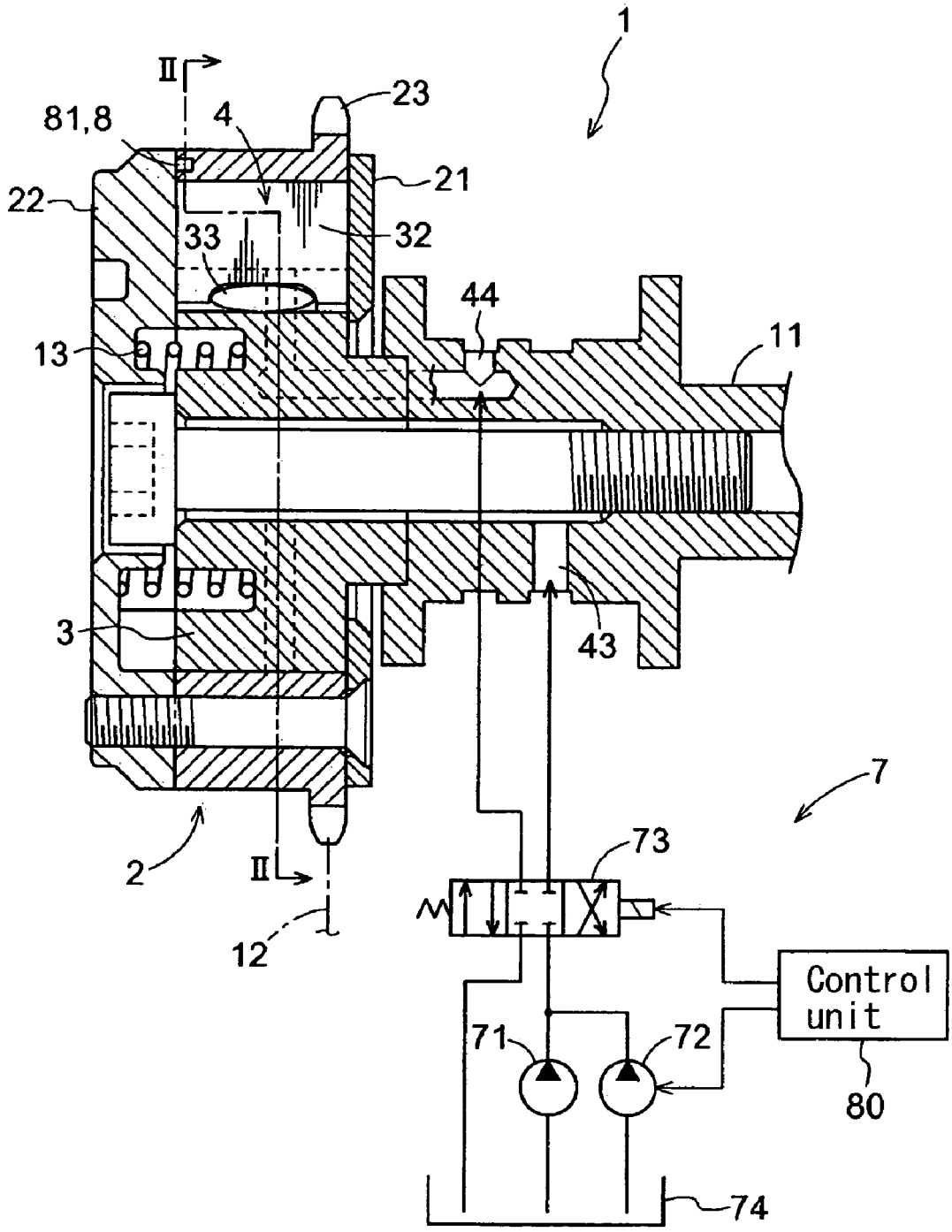
FIG. 1 is a cross-sectional side view illustrating an overall structure of a valve timing control device according to first to third embodiments of the present invention.
Figure 5:
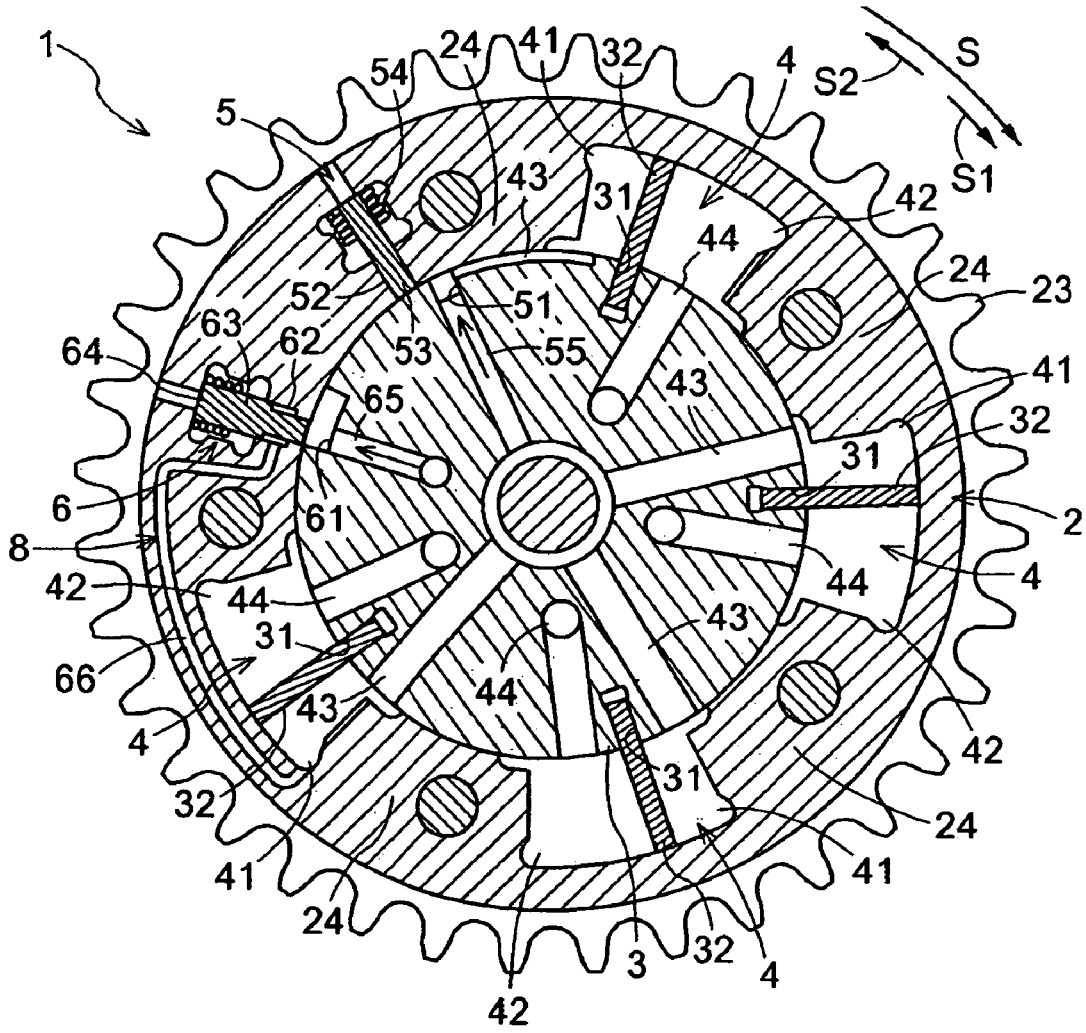
FIG. 5 is a cross-sectional view taken along the line II-II in FIG. 1.
Figure 6:
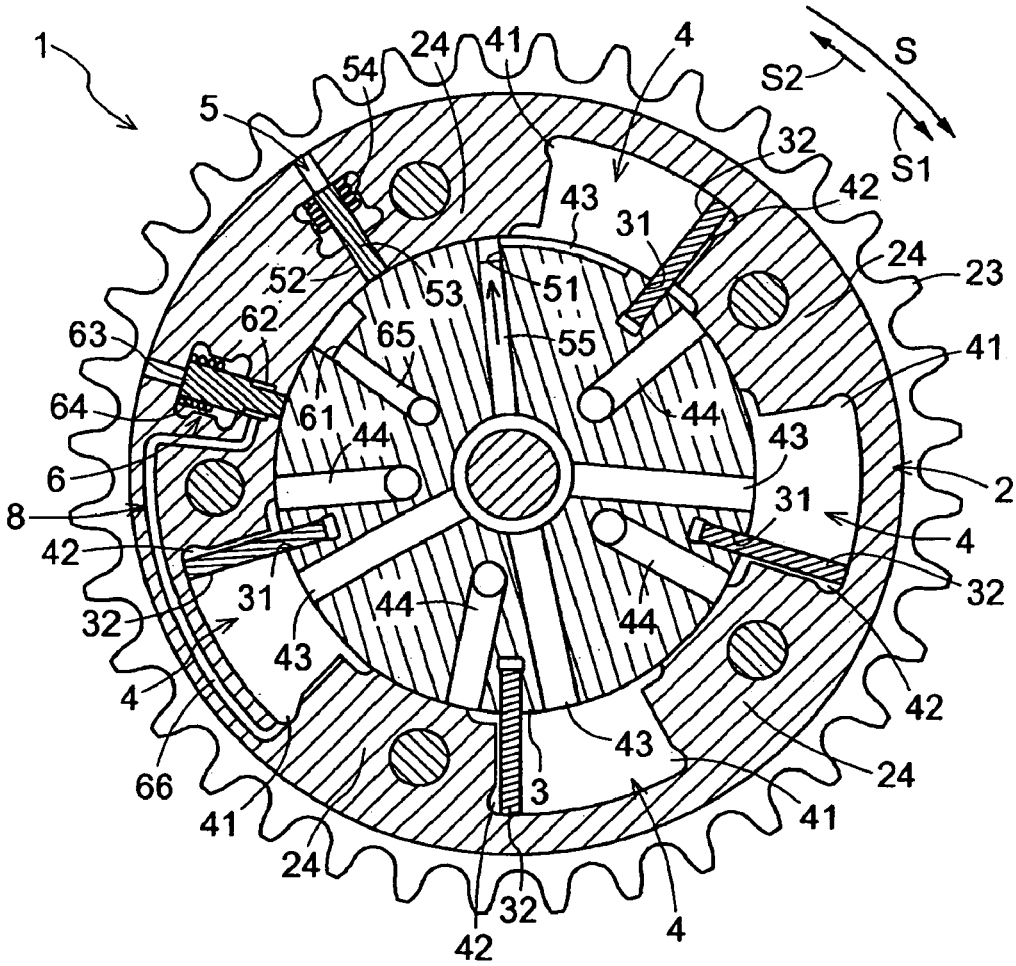
FIG. 6 is a cross-sectional view taken along the line II-II in FIG. 1.
Figure 7:
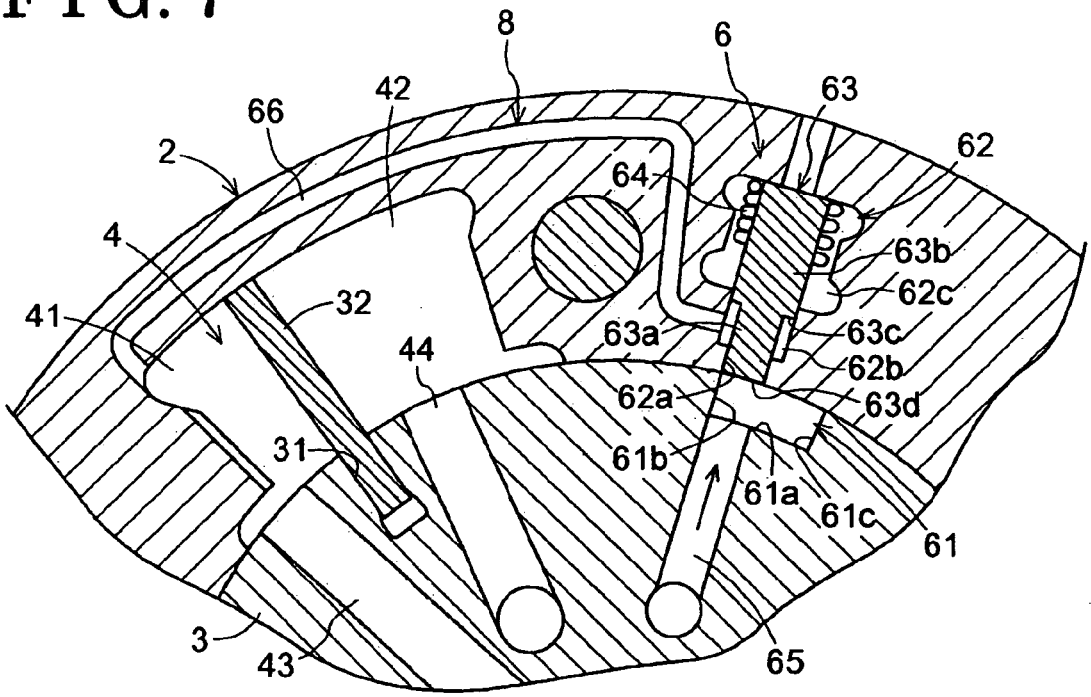
FIG. 7 is an enlarged view of a phase displacement restriction mechanism and a retention mechanism according to the first embodiment of the present invention.
Figure 23:
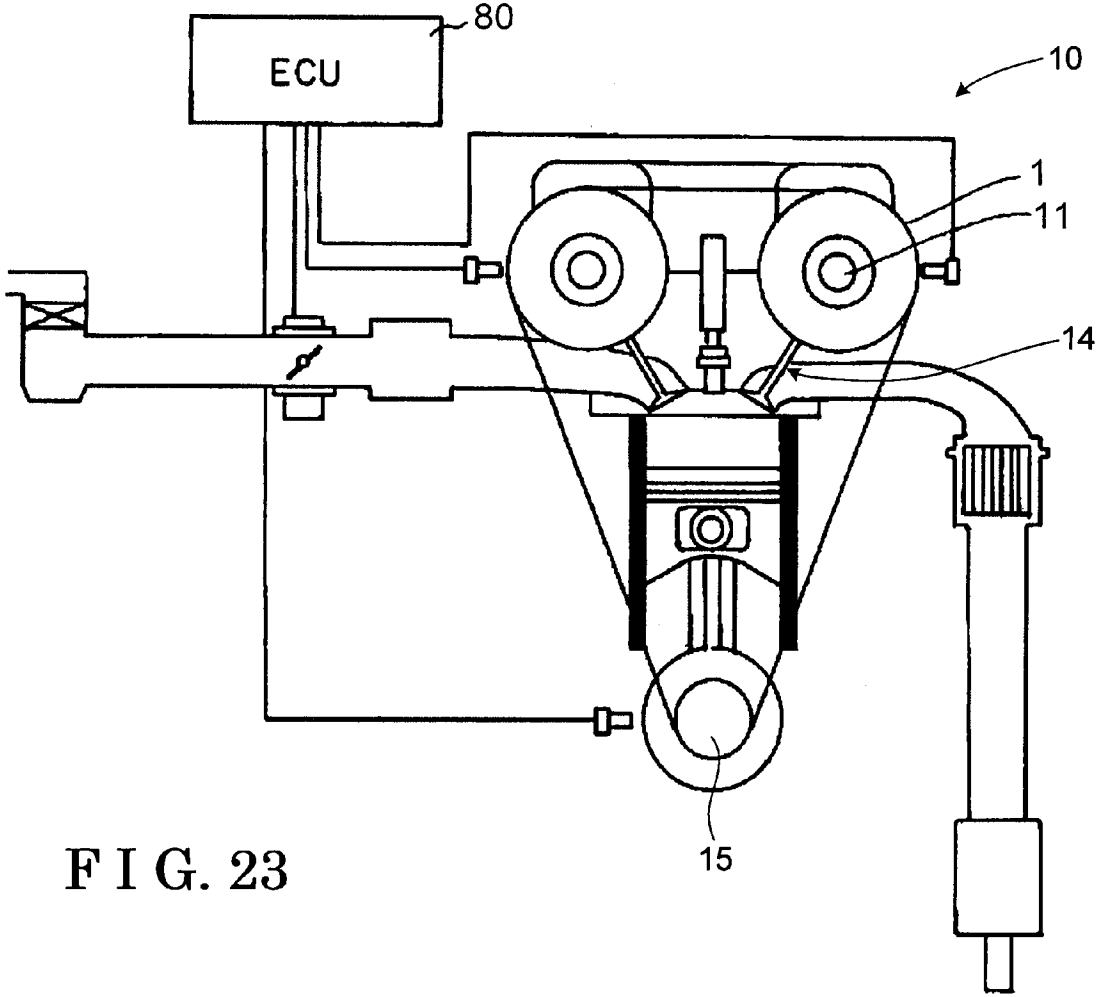
FIG. 23 is a view illustrating the structure of the valve timing control device according to the first to third embodiments of the present invention.

A first embodiment of the present invention will be explained with reference to the attached drawings. FIG. 1 is a cross-sectional side view illustrating an overall structure of a valve timing control device. FIGS. 2 to 6 are cross-sectional views taken along the line II-II in FIG. 1 and showing each status of the valve timing control device. FIG. 7 is an enlarged view of a phase displacement restriction mechanism and a retention mechanism. FIG. 23 is a view illustrating the structure of the valve timing control device.

A valve timing control device 1 includes an outer rotor 2 serving as a driving side rotational member and an inner rotor 3 serving as a driven side rotational member. The outer rotor 2 is synchronously rotatable with a crankshaft 15 of an engine 10 serving as an internal combustion engine. The inner rotor 3 is arranged coaxially with the outer rotor 2 and synchronously rotatable with a camshaft 11.

The inner rotor 3 is integrally attached to an end portion of the camshaft 11 that constitutes a rotation axis of a cam for controlling an opening and closing operation of valves 14 (i.e. an intake valve and an exhaust valve) of the engine 10. The camshaft 11 is rotatably assembled onto a cylinder head (not illustrated) of the engine 10.

The outer rotor 2 is attached on a radially outer side of the inner rotor 3 in such a manner that the outer rotor 2 is relatively rotatable with the inner rotor 3 within a predetermined range. A rear plate 21 and a front plate 22 are integrally attached to the outer rotor 2 and the inner rotor 3 in such a way to sandwich the outer rotor 2 and the inner rotor 3 from axially opposite sides. Precisely, the rear plate is positioned on the axial one side close to the camshaft 11 while the front plate is positioned on the axial other side away from the camshaft 11. A timing sprocket 23 is formed at an outer periphery of the outer rotor 2. Further, a power transmission member 12 such as a timing chain and a timing belt is arranged to extend between the timing sprocket 23 and a gear provided at the crankshaft 15 of the engine 10.

Figure 2:
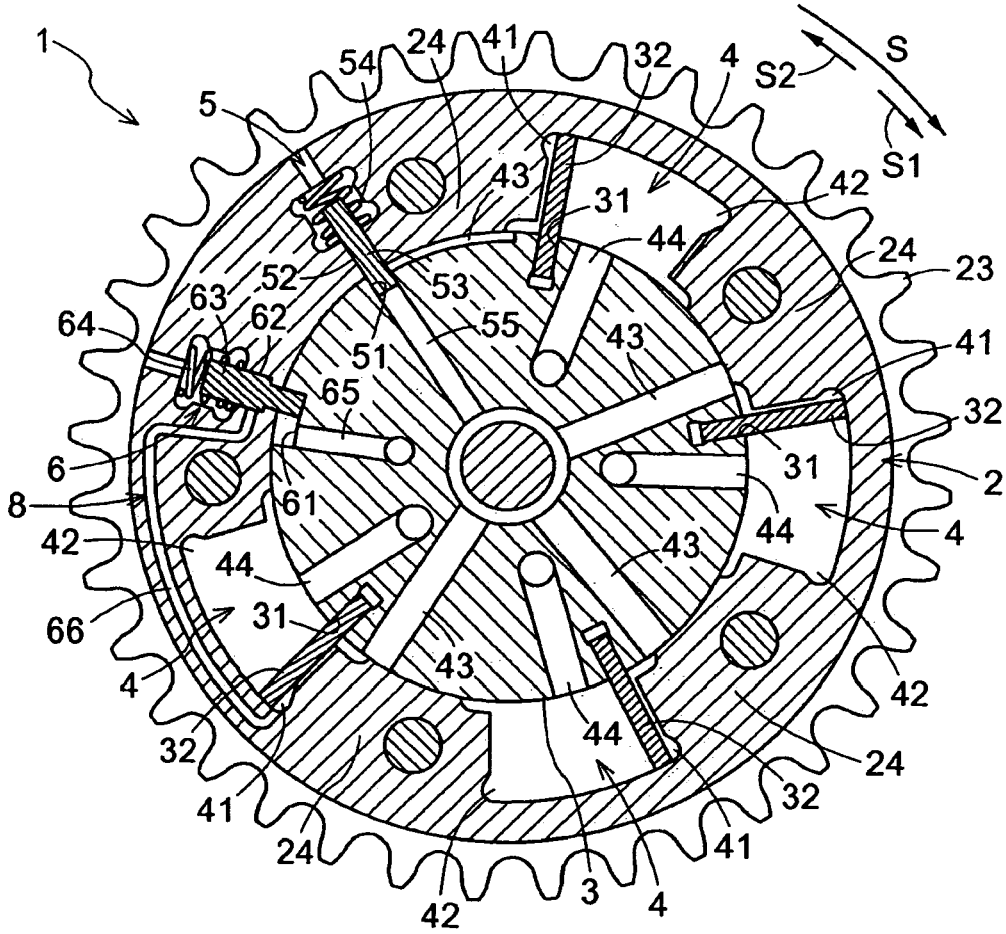
FIG. 2 is a cross-sectional view taken along the line II-II in FIG. 1.

When the crankshaft 15 of the engine 10 is driven to rotate, its rotation power is transmitted to the timing sprocket 23 by means of the power transmission member 12. The outer rotor 2 is then driven to rotate in a direction S as illustrated in FIG. 2. In response to the rotation of the outer rotor 2, the inner rotor 3 rotates in the direction S, which leads to a rotation of the camshaft 11. As a result, the cam provided at the camshaft 11 presses down the valves 14 to be opened.

As illustrated in FIG. 2, multiple protruding portions 24 each functioning as a shoe are arranged along a rotation direction of the outer rotor 2 while keeping a distance from each other in the rotational direction. The protruding portions 24 protrude in a radially inner direction of the outer rotor 2. Then, fluid pressure chambers 4 are defmed by the outer rotor 2 and the inner rotor 3 so as to be arranged, respectively, between the adjacent protruding portions 22. According to the present embodiment, as illustrated in FIG. 2, four fluid pressure chambers 4 are provided.

Vane grooves 31 are formed at an outer periphery of the inner rotor 3 so as to face the fluid pressure chambers 4, respectively. Vanes 32 are inserted into the respective vane grooves 31 in such a way to be slidable in a radial direction of the inner rotor 3. Each vane 32 divides each fluid pressure chamber 4 into an advanced angle chamber 41 and a retarded angle chamber 42 in a relative rotational direction (i.e. directions S1 and S2 in FIG. 2). The vanes 32 are biased radially outwardly by a spring 33 (see FIG. 1) provided at a radially inner side of the vanes 32. The advanced angle chambers 41 and the retarded angle chambers 42 are defined by the outer rotor 2 and the inner rotor 3.

The advanced angle chambers 41 are connected to advanced angle passages 43, respectively, formed at the inner rotor 3. The retarded angle chambers 42 are connected to retarded angle passages 44, respectively, formed at the inner rotor 3. The advanced angle passages 43 and the retarded angle passages 43 are connected to a hydraulic circuit 7, which will be explained later, as illustrated in FIG. 1. As illustrated in FIG. 2, the advanced angle passage 43 communicating with one of the four advanced angle chambers 41 arranged adjacent to a lock mechanism 5 is formed along an outer peripheral surface of the inner rotor 3 that is slidable to an inner peripheral surface of the outer rotor 2 so that an engaging recess portion 51 of the lock mechanism 5 and the advanced angle chamber 41 adjacent to the lock mechanism 5 communicate with each other. The aforementioned advanced angle passage 43 is connected to the hydraulic circuit 7 by means of a lock passage 55. When a fluid such as an operating oil is supplied from the hydraulic circuit 7 to one of or both of the advanced angle chambers 41 and the retarded angle chambers 42, or discharged to the hydraulic circuit 7 from one of or both of the advanced angle chambers 41 and the retarded angle chambers 42, a biasing force is generated for displacing a relative rotational phase between the inner rotor 3 and the outer rotor 2 (hereinafter also simply referred to as "relative rotational phase") in an advanced angle direction S1 (i.e. vane 32 is displaced in a direction shown by the arrow S1 in FIG. 2) or a retarded angle direction S2 (i.e. i.e. vane 32 is displaced in a direction shown by the arrow S2 in FIG. 2), or for retaining the relative rotational phase at an appropriate phase. The predetermined range in which the relative rotational phase between the inner rotor 3 and the outer rotor 2 is displaceable is defined between a most retarded angle phase as illustrated in FIG. 2 and a most advanced angle phase as illustrated in FIG. 6 between which the vanes 32 are displaceable in the respective fluid pressure chambers 4.

As illustrated in FIG. 1, a torsion spring 13 is disposed between the inner rotor 3 and the front plate 22 fixed to the outer rotor 2. Both ends of the torsion spring 13 are held by holding portions formed at the inner rotor 3 and the front plate 22, respectively. The torsion spring 13 constantly biases the inner rotor 3 and the outer rotor 2 in a direction where the relative rotational phase is displaced in the advanced angle direction S1.

The lock mechanism 5 is provided between the outer rotor 2 and the inner rotor 3 for the purposes of locking the relative rotational phase at a predetermined lock phase. As illustrated in FIG. 2, the predetermined lock phase is defined at the most retarded angle phase. The lock mechanism 5 includes a slide groove 52 formed at the outer rotor 2, a lock member 53 slidable along the slide groove 52, a spring 54 biasing the lock member 53 radially inwardly, and the engaging recess portion 51 formed at the inner rotor 3. The lock member 53 is engageable with the engaging recess portion 51 when the relative rotational phase is at the predetermined lock phase. The lock member 53 forms into a plate shape while the slide groove 52 and the engagement recess portion 51 each form into a shape fitting a shape of the lock member 53. Alternatively, the lock member 53 may form into the other shape such as a pin shape.

The engaging recess portion 51 is formed at the inner rotor 3 and with which a radially inner end portion of the lock member 53 is engageable when the relative rotational phase between the inner rotor 3 and the outer rotor 2 is at the predetermined lock phase (i.e. most retarded angle phase). When the lock member 53 is inserted into the engaging recess portion 51 by a biasing force of the spring 54, the lock mechanism 5 is brought to a locked state in which the relative rotational phase is locked at the predetermined lock phase. The predetermined lock phase is defined so that an excellent start-up performance of the engine 10 can be obtained when the engine state such as a temperature in a combustion chamber satisfies a certain condition. The predetermined lock phase is defined at the most retarded angle phase that is an angle phase limit for the engine start available in an entire temperature range of the combustion chamber.

Figure 3:
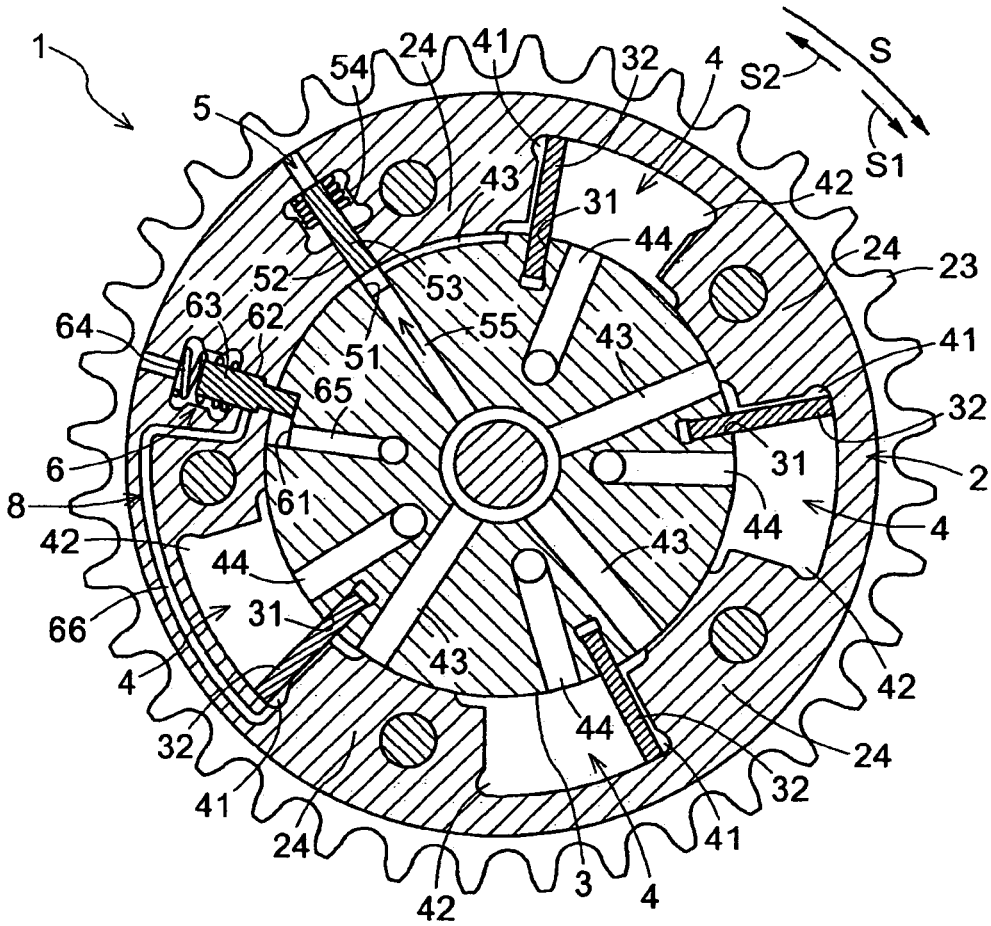
FIG. 3 is a cross-sectional view taken along the line II-II in FIG. 1.

The engaging recess portion 51 communicates with the lock passage 55 formed at the inner rotor 3. The lock passage 55 is connected to the hydraulic circuit 7 and is communicating with the advanced angle passages 43 and the advanced angle chambers 41. The operating oil is supplied from the hydraulic circuit 7 to the engaging recess portion 51 through the lock passage 55, thereby causing the lock mechanism 5 to turn to an unlocked state in which the lock member 53 is retracted from the engaging recess portion 51. That is, when the operating oil is supplied to the engaging recess portion 51 that is then filled therewith and a force radially outwardly biasing the lock member 53 generated from a pressure of the operating oil overcomes the biasing force of the spring 54, the lock member 53 is retracted from the engaging recess portion 51 as illustrated in FIG. 3, thereby achieving the unlocked state in which a displacement of the relative rotational phase between the inner rotor 3 and the outer rotor 2 is allowed. On the other hand, when the operating oil is discharged from the engaging recess portion 51, the lock member 53 is inserted into the engaging recess portion 51 by the biasing force of the spring 54 to thereby cause the lock mechanism 5 to turn to the locked state.

Figure 4:
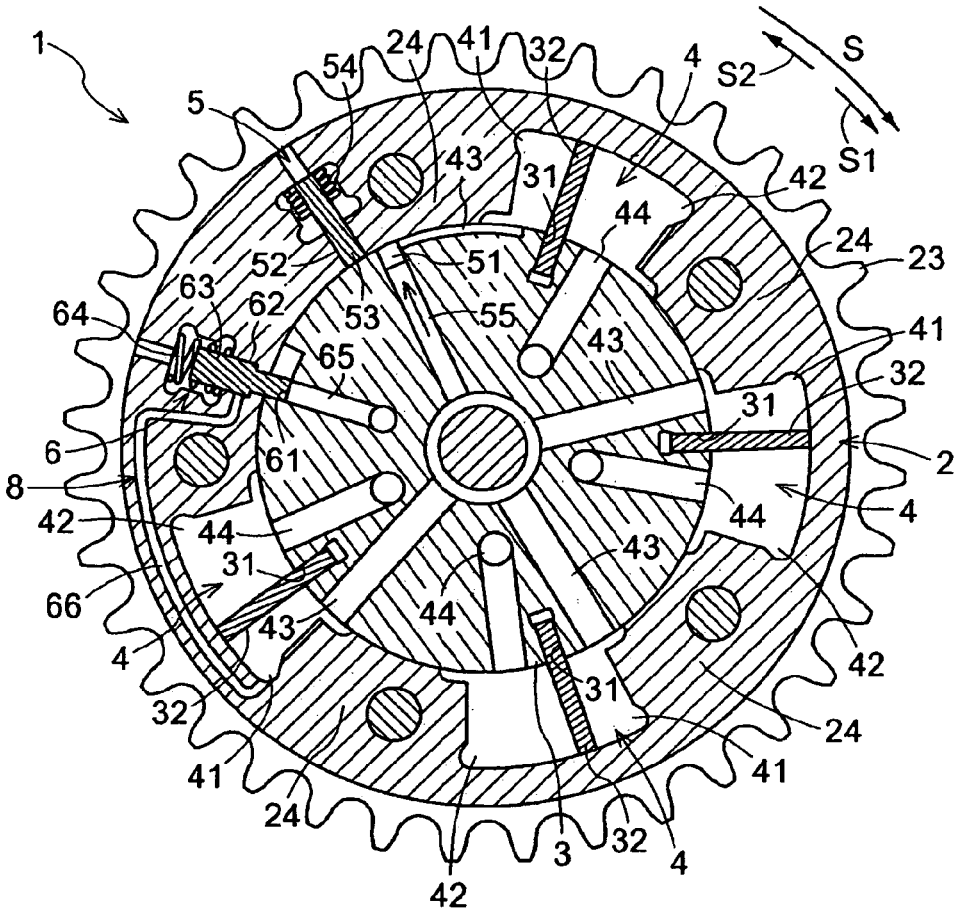
FIG. 4 is a cross-sectional view taken along the line II-II in FIG. 1.

A phase displacement restriction mechanism 6 is provided between the outer rotor 2 and the inner rotor 3. The phase displacement restriction mechanism 6 is able to switch the displacement of the relative rotational phase between a restricted state in which the displacement of the relative rotational phase is restricted within a predetermined phase displacement allowable range and an unrestricted state in which the restriction of the displacement of the relative rotational phase is released. The phase displacement restriction mechanism 6 is independent of the lock mechanism 5 and is operable separately therefrom. Further, the predetermined phase displacement allowable range is defined such as to include the predetermined lock phase (most retarded angle phase). Precisely, one end of the predetermined phase displacement range is defined to be an intermediate restriction (intermediate lock) phase as illustrated in FIG. 4, which will be explained later, while the other end of the predetermined phase displacement range is defmed to be the predetermined lock phase (most retarded angle phase).

The phase displacement restriction mechanism 6 includes a restricting recess portion 61 serving as a recess portion and formed at the inner rotor 3, and an insertion member 63 inserted into or retracted from the restricting recess portion 61 so as to obtain the restricted state and the unrestricted state, respectively. The insertion member 63 is constantly biased in a direction where the insertion member 63 is inserted into the restricting recess portion 61. The insertion member 63 has the substantially similar structure as that of the lock member 53 of the lock mechanism 5. That is, the insertion member 63 is slidably accommodated in a receiving portion 62 formed at the outer rotor 2 and radially inwardly biased by a spring 64. As illustrated in FIG. 7, the insertion member 63 includes a narrow portion 63*a* arranged at a radially inner side, a wide portion 63*b* arranged at a radially outer side, and a stepped portion 63*c* arranged between the narrow portion 63*a* and the wide portion 63*b*, thereby forming a protruding shape. The receiving portion 62, which accommodates the insertion member 63 to be slidable thereto, includes a narrow portion 62*a*, an intermediate portion 62*b*, and a wide portion 62*c* so as to fit the shape of the insertion member 63.

The insertion member 63 can be inserted into the restricting recess portion 61 when the relative rotational phase between the inner rotor 3 and the outer rotor 2 is within the predetermined phase displacement allowable range. Accordingly, the restricting recess portion 61 has a length in the displacement direction of the relative rotational phase corresponding to the predetermined phase displacement allowable range, i.e. a length corresponding to a range in which side faces of the insertion member 63 (i.e. sliding faces to the receiving portion 62) are displaced.

In addition, the restricting recess portion 61 is formed in a predetermined depth from the outer peripheral surface of the inner rotor 3 so that the narrow portion 63*a* of the insertion member 63 can be inserted. As illustrated in FIG. 7, the restricting recess portion 61 includes a bottom surface 61*a* having an arc shape in cross section as in FIG. 2. The narrow portion 63*a* of the insertion member 63 inserted into the restricting recess portion 61 is slidable along the bottom surface 61*a* and therefore the relative rotational phase is displaceable within the predetermined phase displacement allowable range in the restricted state of the phase displacement restriction mechanism 6. In the restricted state in which the insertion member 63 is inserted into the restricting recess portion 61, the displacement of the relative rotational phase beyond the predetermined phase displacement allowable range is restricted by a contact of an either side surface of the narrow portion 63*a* of the insertion member 63 with a first end surface 61*b* or a second end surface 61*c* as illustrated in FIG. 7.

The restricting recess portion 61 communicates with a restriction passage 65 (first passage) formed at the inner rotor 3. The restriction passage 65 is connected to the hydraulic circuit 7 and is communicating with the retarded angle passages 44 and the retarded angle chambers 42. A communication passage 66 (second passage) is provided so that one of the four advanced angle chambers 42 adjacent to the phase displacement restriction mechanism 6 and the receiving portion 62 communicate with each other. While the operating oil is being supplied from the hydraulic circuit 7 to the receiving portion 62 through the communication passage 66, the operating oil is supplied from the hydraulic circuit 7 to the restricting recess portion 61 through the restriction passage 65, thereby achieving the unrestricted state in which the insertion member 63 is retracted from the restricting recess portion 61. That is, when the operating oil is supplied to the restricting recess portion 61 that is then filled therewith and a force radially outwardly biasing the insertion member 63 generated from a pressure of the operating oil overcomes the biasing force of the spring 64, the insertion member 63 is retracted from the restricting recess portion 61 as illustrated in FIG. 5, thereby achieving the unrestricted state in which the displacement of the relative rotational phase between the inner rotor 3 and the outer rotor 2 is allowed to exceed the predetermined phase displacement allowable range. On the other hand, when the operating oil is discharged from the receiving portion 62 and the restricting recess portion 61, the insertion member 63 is inserted into the restricting recess portion 61 by the biasing force of the spring 64, thereby achieving the restricted state.

A retention mechanism 8 is provided for retaining the phase displacement restriction mechanism 6 in the unrestricted state in which the insertion member 63 is retracted from the restricting recess portion 61. The retention mechanism 8 includes a first passage, i.e. the communication passage 66, for supplying a portion of the operating oil, which is supplied to the advanced angle chambers 41, to the receiving portion 62 and a second passage, i.e. the restriction passage 65, for supplying a portion of the operating oil, which is supplied to the retarded angle chambers 41, to the receiving portion 62.

As illustrated in FIG. 7, the first passage 66 is constituted to supply the operating oil to the stepped portion 63*c* formed at a radially middle portion of the insertion member 63 and facing in a radially inner direction in which the insertion member 63 is inserted into the restricting recess portion 61. The stepped portion 63*c* is radially outwardly biased by the pressure of the operating oil supplied from the first passage 66 so that the insertion member 63 is retracted from the restricting recess portion 61. In addition, the second passage 65 is constituted to supply the operating oil to an end portion 63*d* of the narrow portion 63*a* of the insertion member 63 facing in the radially inner direction in which the insertion member 63 is inserted into the restricting recess portion 61. The end portion 63*d* is radially outwardly biased by the pressure of the operating oil supplied from the second passage 65 so that the insertion member 63 is retracted from the restricting recess portion 61. Accordingly, the insertion member 63 is radially outwardly biased by the pressure of the operating oil supplied to one of or both of the advanced angle chambers 41 and the retarded angle chambers 42 so as to obtain a greater biasing force than that of the spring 64, thereby retaining the phase displacement restriction mechanism 6 in the unrestricted state.

Figure 8:
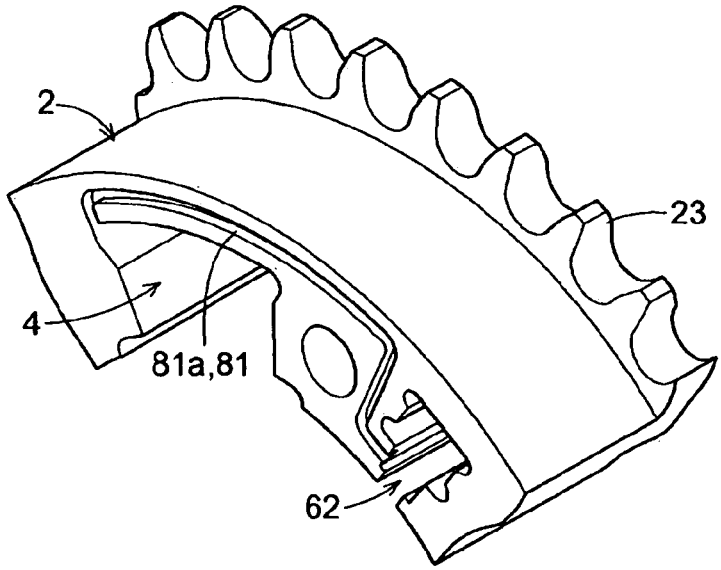
FIG. 8 is a view illustrating a first passage of the retention mechanism.

The outer rotor 2 and the front plate 22, which serves as a cover member for covering the advanced angle chambers 41 and the retarded angle chambers 42, are attached so as to face each other with a passage groove 81*a* formed at the outer rotor 2, as illustrated in FIG. 8, thereby forming the first passage 66 at a mating surface between the front plate 22 and the outer rotor 2. In this case, the passage groove 81*a* may be formed at one of or both of the front plate 22 and the outer rotor 2.

Figure 9:
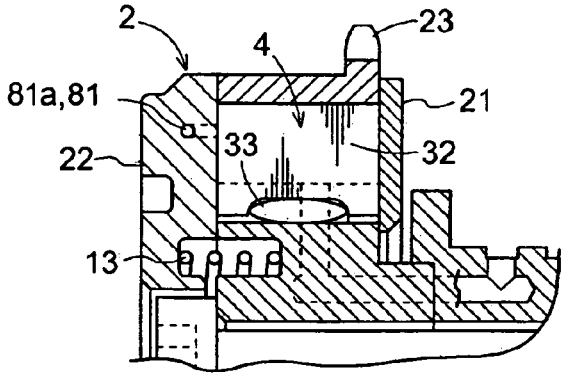
FIG. 9 is a view illustrating the first passage of the retention mechanism.
Figure 10A:
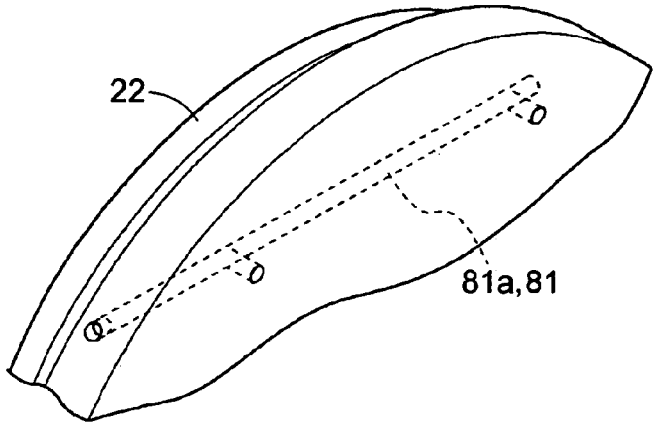
FIG. 10 is a view illustrating the first passage of the retention mechanism.
Figure 10B:
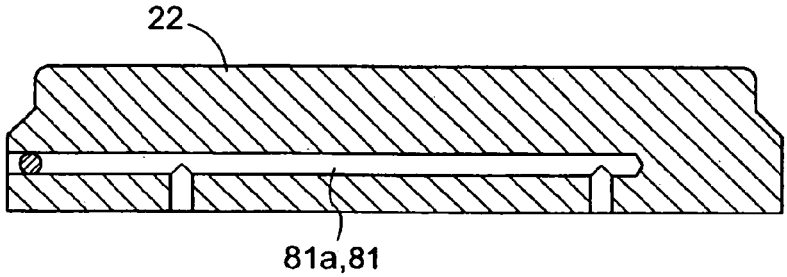

Alternatively, the first passage 66 can be achieved by a through-hole 81*b* having a linear shape and penetrating through the inside of the front plate 22 as illustrated in FIGS. 9, 10A and 10B.

Operations of the lock mechanism 5 and the phase displacement restriction mechanism 6 when the engine 10 is driven to start at the predetermined lock phase (most retarded angle phase) of the relative rotational phase between the inner rotor 3 and the outer rotor 2 will be explained with reference to FIGS. 2 to 6. When the engine 10 is stopped, the lock mechanism 5 is in the locked state in which the lock member 53 is inserted into the engaging recess portion 51 since no operating oil is supplied from the hydraulic circuit 7. At this time, the phase displacement restriction mechanism 6 is in the restricted state in which the insertion member 63 is inserted into the restricting recess portion 61.

That is, no operating oil is supplied from the hydraulic circuit 7 to the advanced angle passages 43, the lock passage 55, the retarded angle passages 44, or the restriction passage 65. The cranking for the engine start is then performed while the valve timing control device 1 is in the state as illustrated in FIG. 2. After the engine start, the operating oil is supplied to the advanced angle passages 43 and the lock passage 55, thereby achieving the unlocked state of the lock mechanism 5 in which the lock member 53 is retracted from the engaging recess portion 51 as illustrated in FIG. 3. At this time, since the operating oil is also supplied to the advanced angle chambers 41 through the advanced angle passages 43, the relative rotational phase is displaced in the advanced angle direction S1 after the lock mechanism 5 is brought to the unlocked state. However, even the operating oil is supplied to the receiving portion 62, the phase displacement restriction mechanism 6 is still in the restricted state. Accordingly, as illustrated in FIG. 4, the side surface of the insertion member 63 is in contact with the first end surface 61*b* of the restricting recess portion 61, and thus the relative rotational phase is locked at the intermediate restriction phase, which is the one end of the predetermined phase displacement allowable range. The intermediate restriction phase is defined so that at this phase the stable combustion of the engine 10 is available when the combustion chamber is in the low temperature so as to reduce hydrocarbon (cold HC) generated immediately after the engine start, for example. Afterwards, when the operating oil is supplied from the hydraulic circuit 7 to the retarded angle passages 44 and the restriction passage 65, the insertion member 63 is retracted from the restricting recess portion 61, thereby achieving the phase displacement restriction mechanism 6 in the unrestricted state. Accordingly, as illustrated in FIG. 5, the relative rotational phase can be displaced to any positions within a relative rotation allowable range, i.e. between the most retarded angle phase and the most advanced angle phase. At this time, since the operating oil is supplied to the receiving portion 62 from either one of or both of the first passage 66 and the second passage 65, the insertion member 63 is radially outwardly biased by the pressure of the operating oil supplied from either one of or both of the first passage 66 and the second passage 65, thereby retaining the insertion member 63 to be retracted from the restricting recess portion 61.

Further, the supply of the operating oil from the hydraulic circuit 7 to the advanced angle passages 43 and the lock passage 55 communicating with the advanced angle passages 43 at a time of or before the cranking for the engine start can realize the engine start at the intermediate restriction phase, instead of the predetermined lock phase, of the relative rotational phase as illustrated in FIG. 4.

Next, a structure of the hydraulic circuit 7 according to the present embodiment will be explained below. As illustrated in FIG. 1, the hydraulic circuit 7 includes a first pump 71 driven by the engine 10 so as to supply the operating oil, a second pump 72 driven by an other power source than the engine 10 so as to supply the operating oil, the fluid pressure chambers 4, and a control valve 73. The control valve 73 serving as a fluid supply and discharge mechanism controls the operating oil to be supplied to or discharged from the lock mechanism 5 and the phase displacement restriction mechanism 6. In addition, the hydraulic circuit 7 includes a control unit 80 such as an electronic control unit (ECU) for controlling operations of the second pump 72 and the control valve 73.

The first pump 71 is a mechanical hydraulic pump driven by receiving a driving force of the crankshaft 15 of the engine 10. The first pump 71 absorbs the operating oil stored in an oil pan 74 through an intake port and then discharges the operating oil through a discharge port to a downstream side. The second pump 72 is an electric pump driven by the other power source than the engine 10, i.e. an electric motor, for example, in this case. Accordingly, the second pump 72 is operable in response to an actuation signal from the control unit 80 regardless of the operation state of the engine 10. The second pump 72 absorbs the operating oil stored in the oil pan 74 through an intake port and then discharges the operating oil through a discharge port to the downstream side.

In the cases where the engine 10 starts operating, the first pump 71 supplies or discharges the operating oil to or from the fluid pressure chambers 4, the lock mechanism 5, and the phase displacement restriction mechanism 6. In the case of the engine stop, the second pump 72 supplies or discharges the operating oil to or from the fluid pressure chambers 4, the lock mechanism 5, and the phase displacement restriction mechanism 6. When the revolution of the engine 10 decreases and thus the first pump 71 is unable to supply the operating oil with the sufficient pressure, the second pump 72 can be operated to supply the operating oil.

The control valve 73 is a variable magnetic spool valve, for example, in which a spool slidably arranged within a sleeve is displaced by means of a power supply to a solenoid from the control unit 80 against a biasing force of a spring. The control valve 73 includes an advanced angle port communicating with the advanced angle passages 43 and the lock passage 55, a retarded angle port communicating with the retarded angle passages 44 and the restriction passage 65, a supply port communicating with a fluid passage on the downstream side of the second pump 72, and a drain port communicating with the oil pan 74. The control valve 73 is a three-position control valve that can perform a three-state control, i.e. an advanced angle control, a retarded angle control, and a hold control. In the advanced angle control, the advanced angle port communicates with the supply port and the retarded angle port communicates with the drain port. In the retarded angle control, the retarded angle port communicates with the supply port and the advanced angle port communicates with the drain port. In the hold control, the advanced angle port and the retarded angle port are closed. The control valve 73 is controlled by the control unit 80 to operate so as to control the operating oil to be supplied to or discharged from the advanced angle chambers 41 and the engaging recess portion 51 of the lock mechanism 5, and also the retarded angle chambers 42 and the restricting recess portion 61 of the phase displacement restriction mechanism 6. Accordingly, the control valve 73 performs a switch control for switching the lock mechanism 5 between the locked state and the unlocked state, and a switch control for switching the phase displacement restriction mechanism 6 between the restricted state and the unrestricted state, and a control of the relative rotational phase between the inner rotor 2 and the outer rotor 3.

Figure 11:
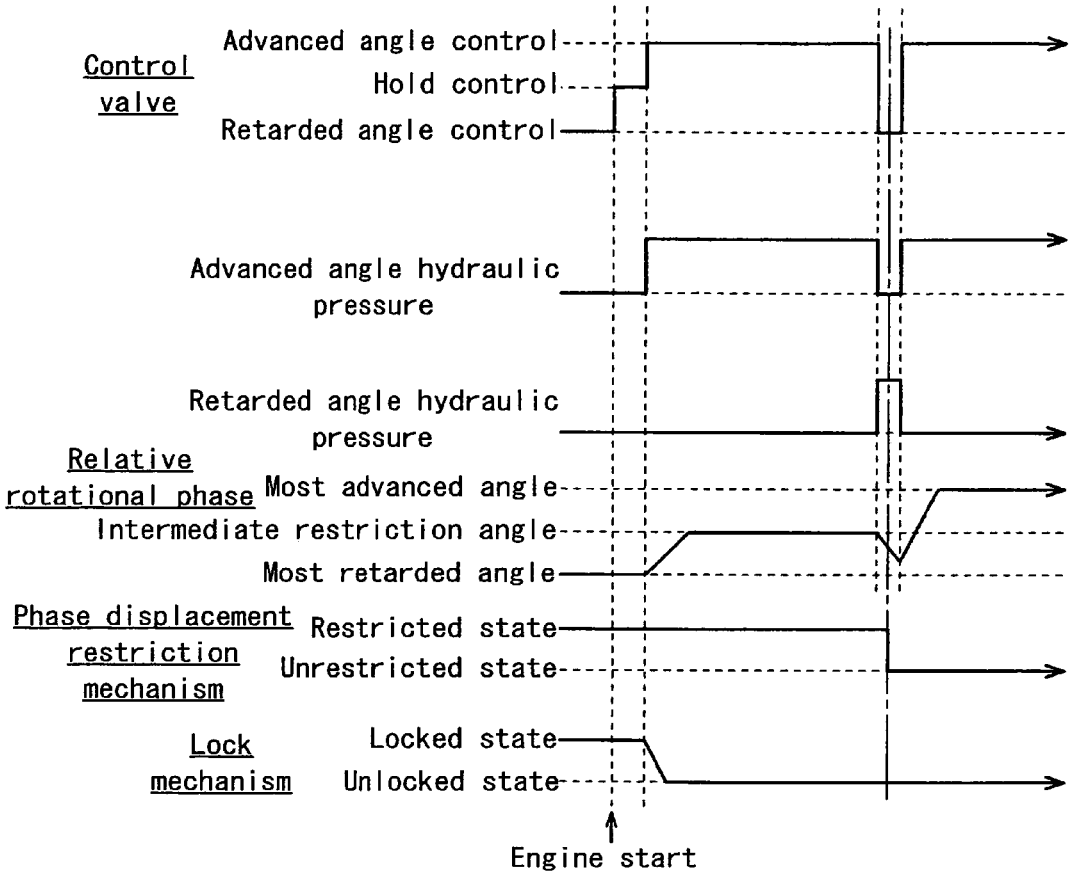
FIG. 11 is a timing chart illustrating an operation example of the valve timing control device according to the first embodiment of the present invention.

Next, an example of an operation of the valve timing control device 1 when the engine 10 starts in a state where the relative rotational phase is at the predetermined lock phase (most retarded angle phase) will be explained with reference to a timing chart shown in FIG. 11. In the cases where the engine 10 is stopped, the first pump 71 and the second pump 72 are both stopped. At this time, the relative rotational phase is at the predetermined lock phase (most retarded angle phase) as illustrated in FIG. 2. The lock mechanism 5 is in the locked state in which the lock member 53 projects to be inserted into the engaging recess portion 51 and the phase displacement restriction mechanism 6 is in the restricted state in which the insertion member 63 projects to be inserted into the restricting recess portion 61. Then, the cranking is started to activate the engine 10 while the relative rotational phase is locked at the predetermined lock phase. When the engine operation becomes stable, the control unit 80 brings the control valve 73 in the advanced angle control state so as to supply the operating oil to the advanced angle chambers 41 and the engaging recess portion 51 of the lock mechanism 5. The lock mechanism 5 then turns to the unlocked state in which the lock member 53 is retracted from the engaging recess portion 51 as illustrated in FIG. 3 from the locked state in which the lock member 53 is inserted into the engaging recess portion 51. At this time, the operating oil is also supplied to the receiving portion 62 from the first passage 66. After the lock mechanism 5 turns to the unlocked state, the relative rotational phase is displaced in the advanced angle direction. At this time, however, the phase displacement restriction mechanism 6 is in the restricted state in which the operating oil is supplied only to the receiving portion 62 and thus the displacement of the relative rotational phase is restricted within the predetermined phase displacement allowable range. As a result, as illustrated in FIG. 4, the relative rotational phase is locked at the intermediate restriction phase, which is the one end of the predetermined phase displacement allowable range.

When a predetermined time has elapsed, the control unit 80 brings the control valve 73 in the retarded angle control state so as to supply the operating oil to the retarded angle chambers 42 and the restricting recess portion 61 of the phase displacement restriction mechanism 6. The phase displacement restriction mechanism 6 then turns to the unrestricted state as illustrated in FIG. 5 in which the insertion member 63 is retracted from the restricting recess portion 61 from the restricted state in which the insertion member 63 is inserted into the restricting recess portion 61. At this time, the supply of the operating oil to the retarded angle chambers 42 prevents the unstable displacement of the relative rotational phase that may occur when the retarded angle chambers 42 are empty, i.e. with no operating oil, when the phase displacement restriction mechanism 6 turns to the unlocked state.

Afterwards, the control unit 80 controls the relative rotational phase to be displaced to any positions (not illustrated). At this time, the operating oil is supplied from the first passage 66 to the stepped portion 63*c* of the insertion member 63 that has been retracted from the restricting recess portion 61, and also from the second passage 65 to the end portion 63*d* of the insertion member 63. Accordingly, the insertion member 63 is radially outwardly biased by the pressure of the operating oil supplied from either one of or both of the first passage 66 and the second passage 65 so that the phase displacement restriction mechanism 6 is retained in the unrestricted state.

Next, a second embodiment of the valve timing control device will be explained with reference to FIGS. 12A and 12B. In the second embodiment, the retention mechanism 8 is different from that of the first embodiment. Thus, the retention mechanism 8 will be explained below and the explanation of the other structure will be omitted.

Figure 12A:
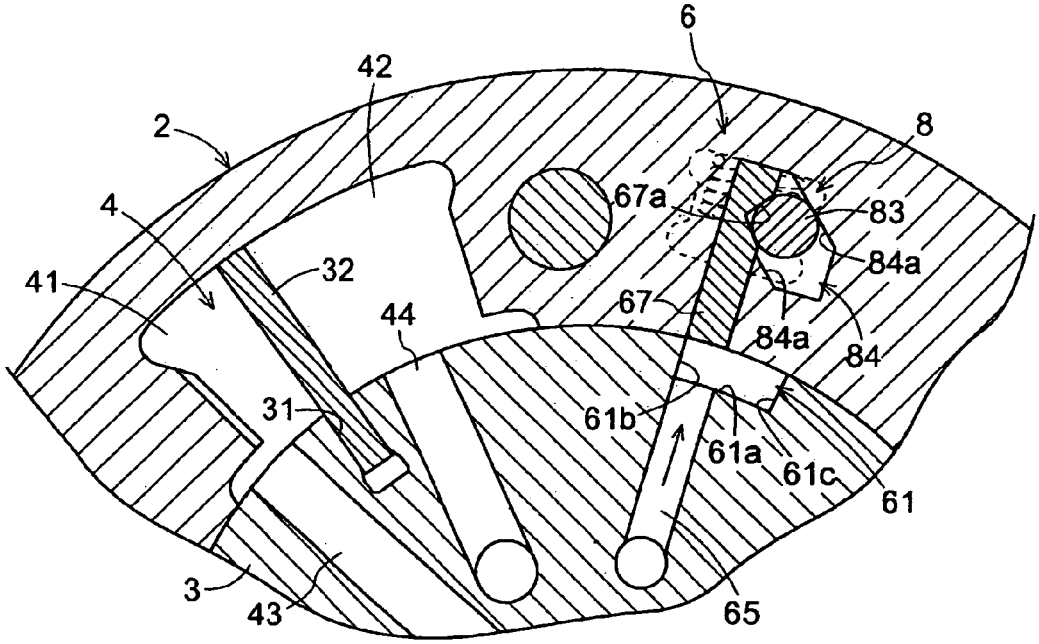
FIGS. 12A and 12B are enlarged views of the retention mechanism according to the second embodiment of the present invention.
Figure 12B:
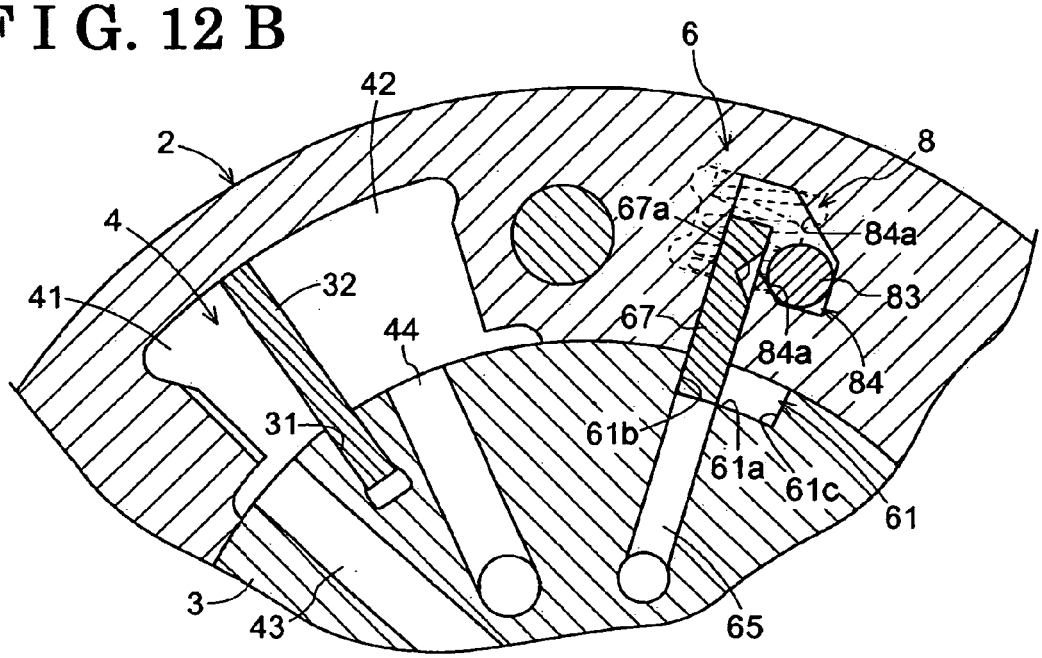

As illustrated in FIGS. 12A and 12B, the retention mechanism 8 includes an engaging member 83 that engages with an engaged portion 67*a* formed at a flat-shaped insertion member 67 when the insertion member 67 is retracted from the restricting recess portion 61. The engaged portion 67*a* forms into a recess shape at a radially middle portion of the insertion member 67. The insertion member 67 may form into a pin shape, and the like, instead of the shape illustrated in FIGS. 12A and 12B.

The engaging member 83 having a ball shape is movable in the rotation direction and the radial direction of the outer rotor 2 and the inner rotor 3 within a hollow portion 84 formed at the outer rotor 2. The hollow portion 84 includes a guide face 84*a* serving as a guiding member for guiding the engaging member 83 radially outwardly so that the engaging member 83 moves close to the engaged portion 67*a*.

In the cases where the phase displacement restriction mechanism 6 turns to the unrestricted state in which the insertion member 67 is retracted from the restricting recess portion 61, the engaging member 83 engages with the engaged portion 67*a* as illustrated in FIG. 12A. That is, at this time, a centrifugal force generated by the rotation of the outer rotor 2 and the inner rotor 3 brings the engaging member 83 to move in a radially outward direction. Accordingly, the engaging member 83 is guided by the guide face 84*a* towards the engaged portion 67*a* so as to retain engagement therewith. As a result, the insertion member 67 is kept retracted from the restricting recess portion 61.

Meanwhile, when the centrifugal force generated by the rotation of the outer rotor 2 and the inner rotor 3 decreases or disappears because of the engine stop and the like, the engaging member 83 is movable by means of the guide face 84*a* in a direction to be separated from the engaged portion 67*a*. Thus, as illustrated in FIG. 12B, the insertion member 67 moves to be inserted into the restricting recess portion 61 by the biasing force of the spring 64.

Figure 16:
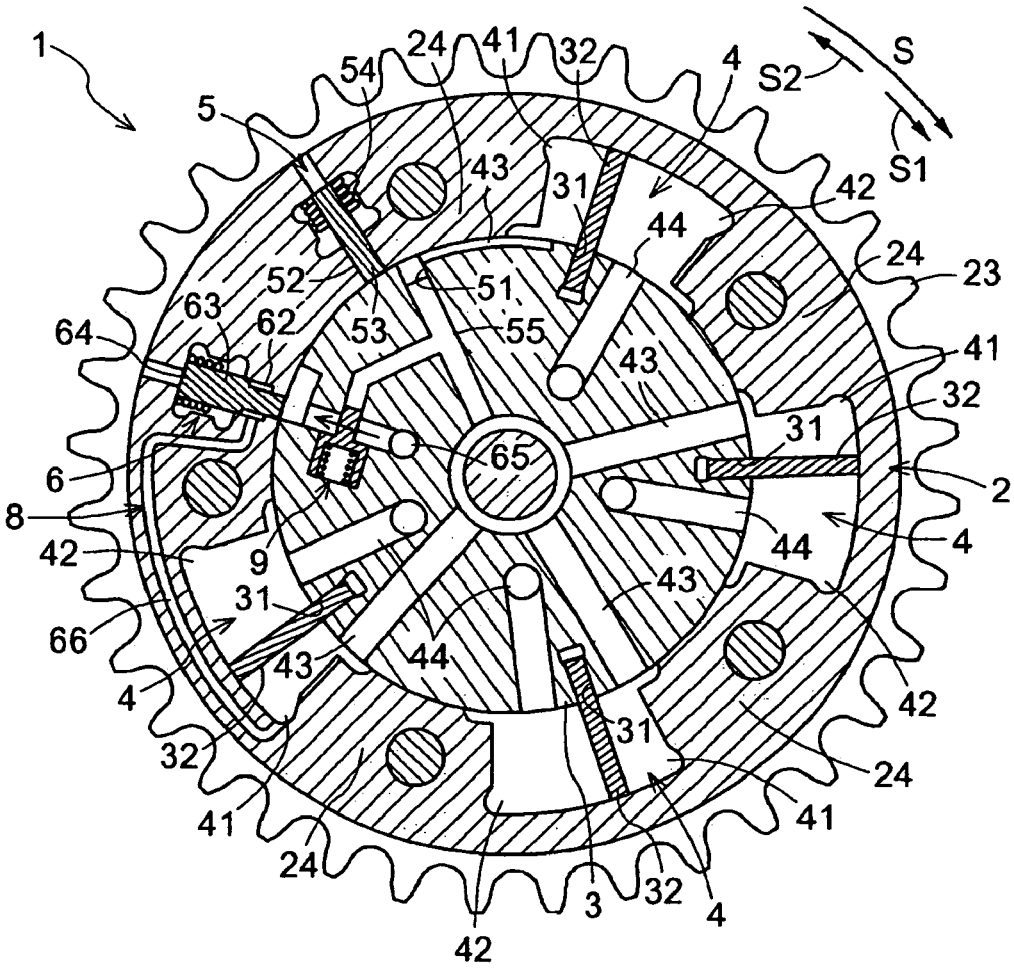
FIG. 16 is a cross-sectional view taken along the line II-II in FIG. 1 according to the third embodiment of the present invention.
Figure 17:
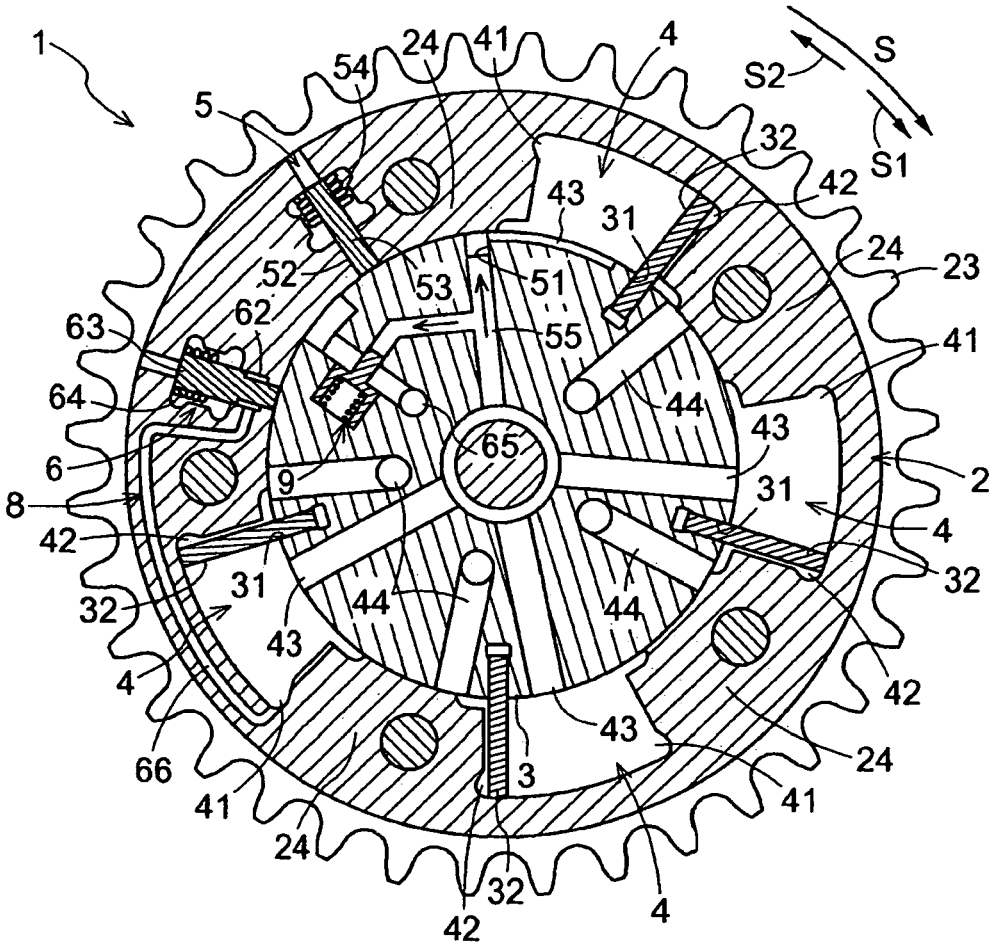
FIG. 17 is a cross-sectional view taken along the line II-II in FIG. 1 according to the third embodiment of the present invention.
Figure 18:
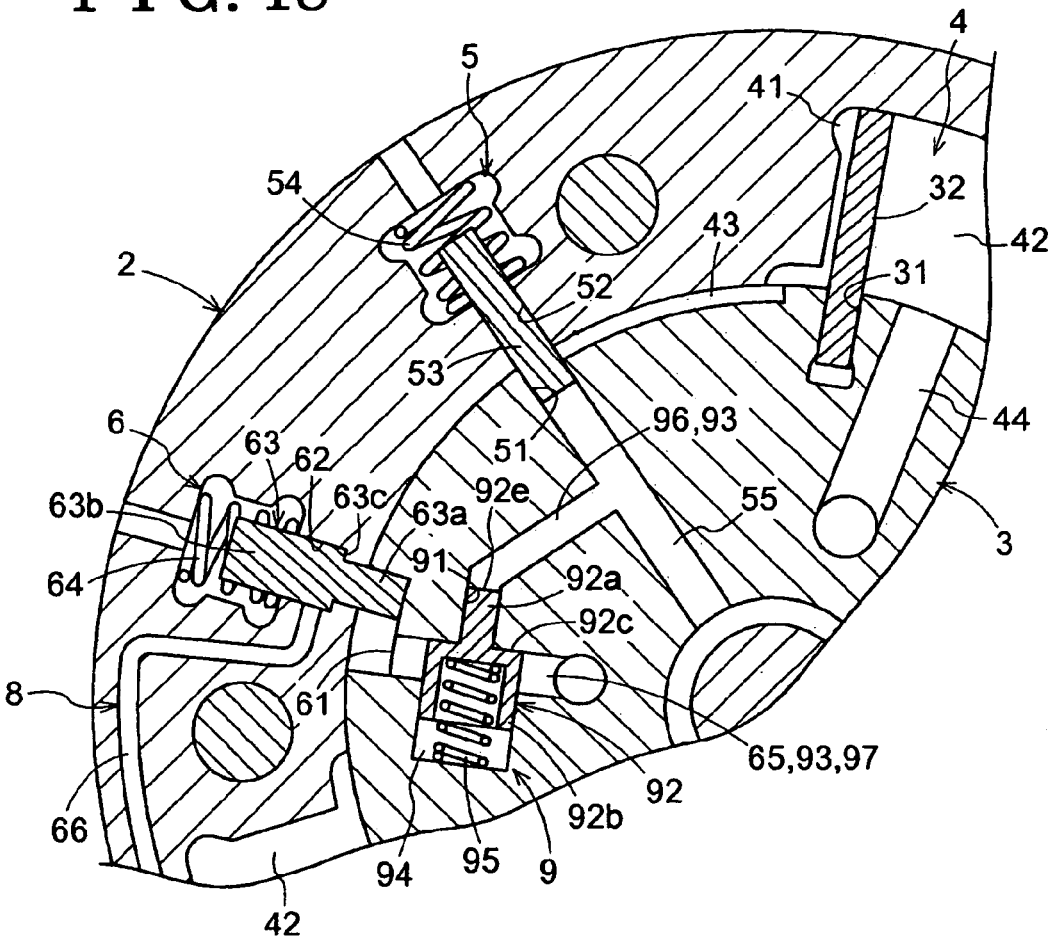
FIG. 18 is an enlarged view of a valve mechanism.

A third embodiment of the valve timing control device will be explained below. The third embodiment is obtained by adding a valve mechanism 9 to the first embodiment. The valve mechanism 9 will be explained below and the explanation of the other structure will be omitted. FIGS. 13 to 17 are cross-sectional views taken along the line II-II in FIG. 1 and showing each state of the valve timing control device. FIG. 18 is an enlarged view of the valve mechanism 9.

The valve mechanism 9 is provided at the restriction passage 65 communicating with the retarded angle passages 44 and the retarded angle chambers 42. The valve mechanism 9 turns to an open state when a portion of the operating oil, which is supplied to the advanced angle chambers 41, is supplied to the valve mechanism 9, and also retains the open state when a portion of the operating oil, which is supplied to at least one of the advanced angle chambers 41 and the retarded angle chambers 42, is supplied to the valve mechanism 9. The restriction passage 65 is constituted so that a portion of the operating oil supplied to the retarded angle chambers 42 is supplied to the restricting recess portion 61. According to the third embodiment, the retarded angle chamber 42 corresponds to one of the advanced angle chamber and the retarded angle chamber, and the advanced angle chamber 41 corresponds to the other one of the advanced angle chamber and the retarded angle chamber.

As illustrated in FIG. 18, the valve mechanism 9 includes a valve valve recess portion 91 to which a portion of the operating oil supplied to the advanced angle chambers 41 is supplied, and a valve body 92 that can be inserted into the valve valve recess portion 91 to thereby achieve an open state and be retracted from the valve valve recess portion 91 to thereby achieve a closed state. The valve body 92 is constantly biased to be inserted into the valve recess portion 91 and is slidable along a slide groove 94 formed at the inner rotor 3. The valve recess portion 91, into which a portion of the valve body 92 can be inserted, is constituted by a passage formed narrower than the slide groove 94 and communicating therewith. The valve body 92 is biased by a spring 95 in a direction to be inserted into the valve recess portion 91.

Figure 19:
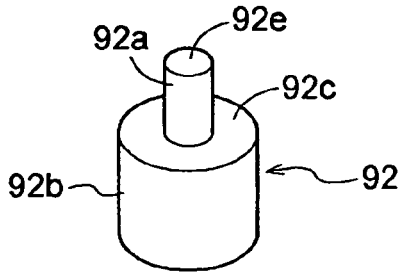
FIG. 19 is a perspective view of a valve body of the valve mechanism.

As illustrated in FIG. 19, the valve body 92 includes a narrow portion 92*a* inserted into the valve recess portion 91 and a wide portion 92*b* wider than the narrow portion 92*a*, thereby forming into a protruding shape. A stepped portion 92*c* is formed between the narrow portion 92*a* and the wide portion 92*b* so as to face in a direction where the valve body 92 is inserted into the valve recess portion 91. Further, as illustrated in FIG. 18, the insertion member 63 and the valve body 92 have the similar protruding shapes constituted, respectively, by the narrow portions 63*a* and 92*a*, the wide portions 63*b* and 92*b*, and the stepped portions 63*c* and 92*c* facing in the direction where the insertion member 63 and the valve body 92 are inserted into the restricting recess portion 61 and the valve recess portion 91, respectively. The insertion member 63 and the valve body 92 are arranged in series with each other in a fluid passage communicating with the retarded angle chambers 42.

The valve mechanism 9 includes a valve body holding mechanism 93 for achieving the open state of the valve body 92 when a portion of the operating oil supplied to the advanced angle chambers 41 is supplied to the valve mechanism 9, and for retaining the open state of the valve body 92 when a portion of the operating oil supplied to at least one of the advanced angle chambers 41 and the retarded angle chambers 42 is supplied to the valve mechanism 9. The valve body holding mechanism 93 includes a third passage 96 for supplying a portion of the operating oil supplied to the advanced angle chambers 41 to an end portion 92*e* formed at the valve body 92 so as to face in the direction where the valve body 92 is inserted into the valve recess portion 91, and a fourth passage 97 for supplying a portion of the operating oil supplied to the retarded angle chambers 42 to a stepped portion 92*c* formed at a middle portion of the valve body 92 in the direction where the valve body 92 is inserted into or retracted from the valve recess portion 91.

The lock passage 55 and the valve recess portion 91 communicate with each other by means of the third passage 96 so that a portion of the operating oil supplied to the advanced angle chambers 41 is supplied to the end portion 92*e* of the valve body 92. Because of the pressure of the operating oil supplied by means of the third passage 96, the valve body 92 is retracted from the valve recess portion 91 so as to turn to the open state. That is, when the operating fluid is supplied to the valve recess portion 91 that is then filled therewith and a force generated by the pressure of the operating oil for biasing the valve body 92 to be retracted from the valve recess portion 91 overcomes the biasing force of the spring 95, the valve body 92 is retracted from the valve recess portion 91 so as to turn to the open state. The open state of the valve body 92 is retained by the application of the force to the end portion 92*e*, the force being generated by the pressure of the operating oil supplied by means of the third passage 96 and biasing the valve body 92 to be retracted from the valve recess portion 91.

The fourth passage 97 is a part of the restriction passage 65 and by means of which a portion of the operating oil, which is supplied to the retarded angle chambers 42, is supplied to the stepped portion 92*c* of the valve body 92 when the valve body 92 turns to the open state. The open state of the valve body 92 is retained by the application of the force to the stepped portion 92*c*, the force being generated by the pressure of the operating oil supplied by means of the fourth passage 97 and biasing the valve body 92 to be retracted from the valve recess portion 91.

Figure 20:
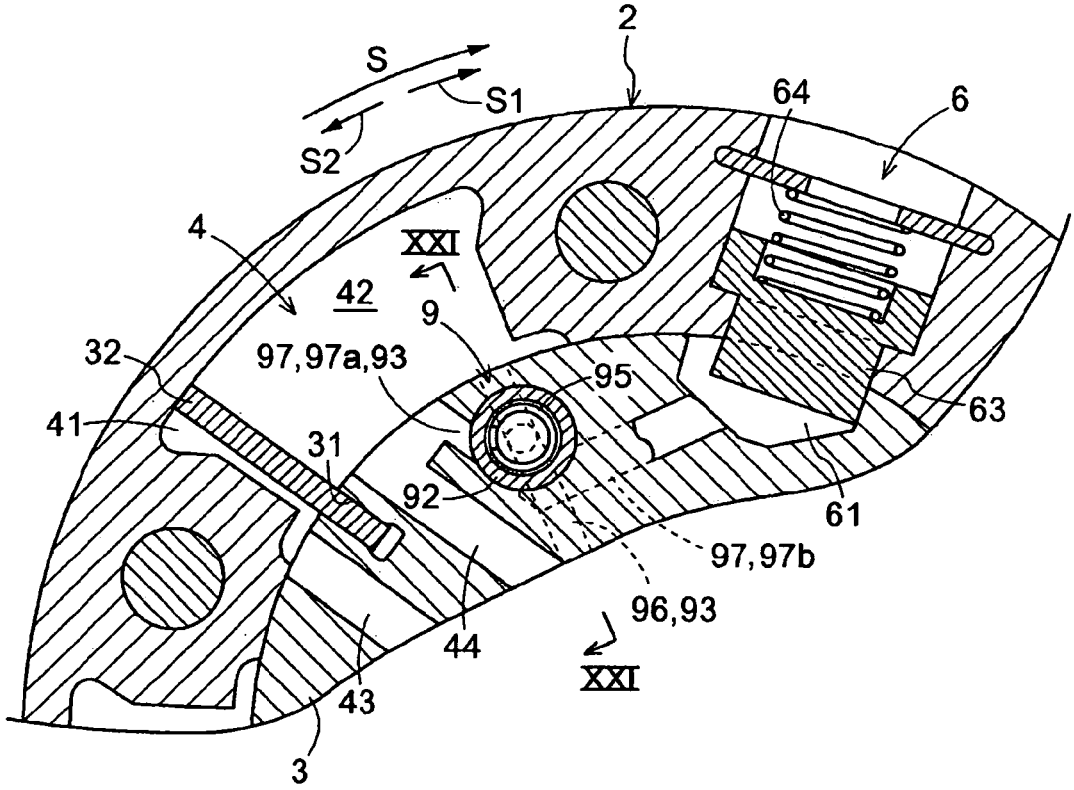
FIG. 20 is an enlarged view of the valve mechanism.
Figure 21A:
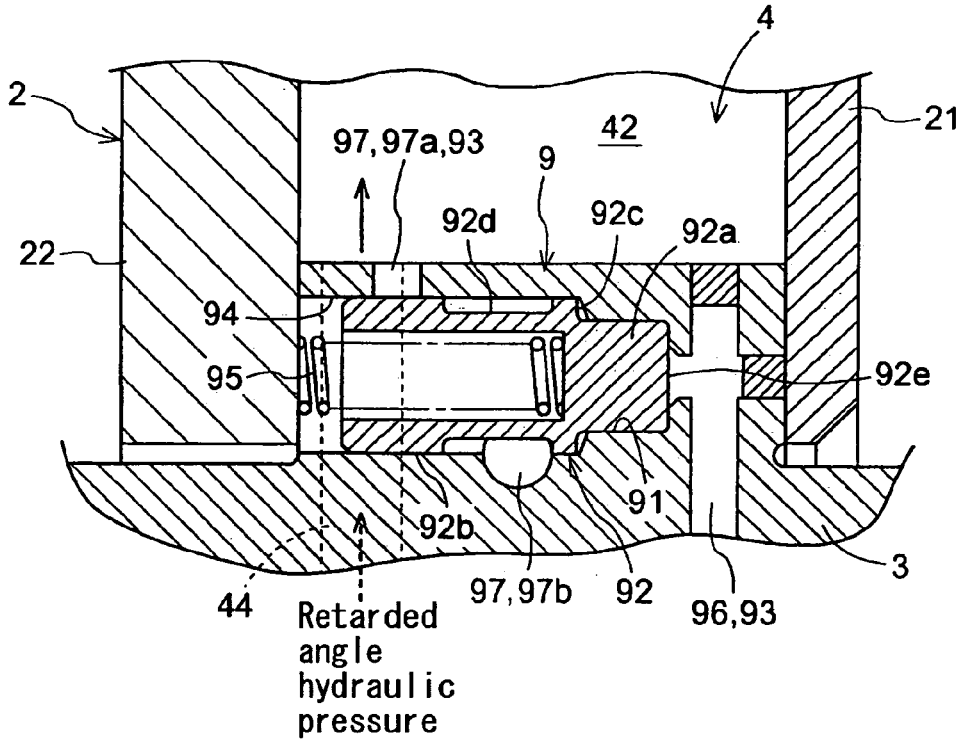
FIGS. 21A and 21B are cross-sectional views each taken along the line XXI-XXI in FIG. 20.
Figure 21B:
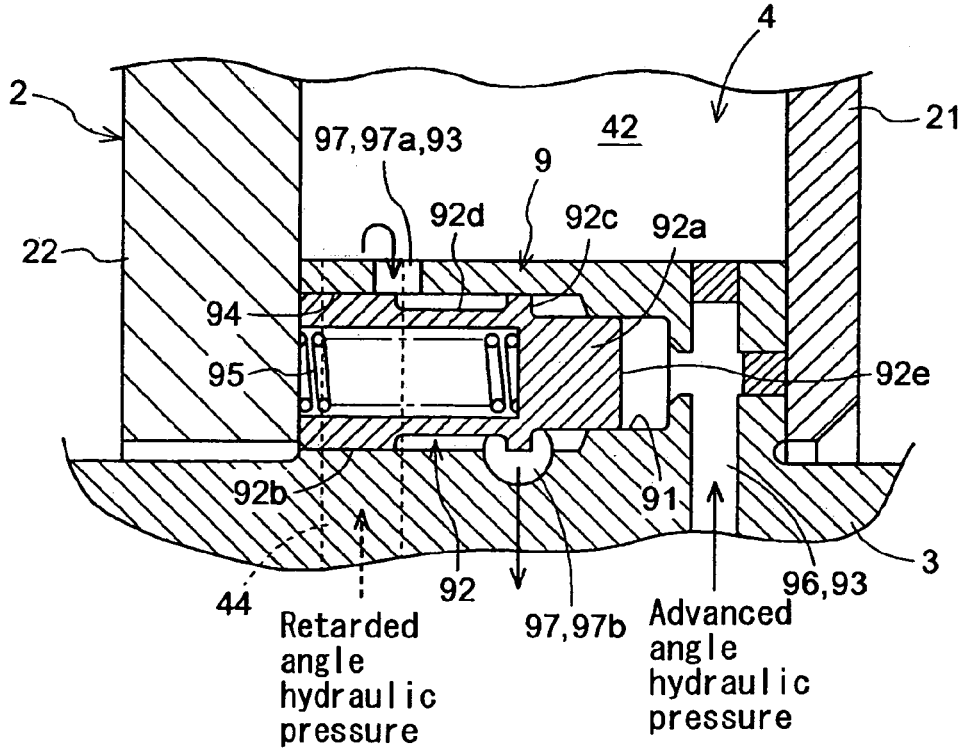

When the valve mechanism 9 is arranged in such a manner as illustrated in FIG. 18, i.e. the insertion and retraction of the valve body 92 are conducted in a direction perpendicular to the rotation axis of the inner rotor 3 and the outer rotor 2, it may be difficult to form or process the slide groove 94, and the like. Then, as illustrated in FIGS. 20 and 21, the valve body 92 can be arranged so as to be inserted or retracted along the rotation axis of the inner rotor 3 and the outer rotor 2. FIG. 20 is a cross-sectional enlarged view of the valve mechanism 9 taken along the line II-II in FIG. 1. FIGS. 21A and 21B are cross-sectional views taken along the line XXI-XXI in FIG. 20. FIG. 21A illustrates the closed state of the valve mechanism 9 and FIG. 21B illustrates the open state of the valve mechanism 9.

Precisely, the slide groove 94 is formed in a direction along the rotation axis of the inner rotor 3 and the outer rotor 2 so that the valve body 92 is inserted or retracted along the rotation axis of the inner rotor 3 and the outer rotor 2. The valve recess portion 91 is formed by a narrow passage communicating with the slide groove 94. The third passage 96 is formed so as to communicate with the valve recess portion 91. The fourth passage 97 is formed by cutting a portion of the retarded angle passage 44 communicating with the retarded angle chamber 42. The fourth passage 97 includes an entrance side communication portion 97*a* through which the operating oil from the retarded angle chamber 42 is supplied to the slide groove 94 and an exit side communication portion 97*b* through which the operating oil discharged from the slide groove 94 is supplied to the restricting recess portion 61. The valve body 92 includes a dent portion 92*d* formed over an entire periphery of the wide portion 93*b* in such a manner to be dented in a radially inner direction thereof.

In the closed state as illustrated in FIG. 21A in which the valve body 92 is inserted into the valve recess portion 91, the entrance side communication portion 97*a* is covered by the valve body 92. Thus, even the operating oil is supplied to the retarded angle chamber 42, the operating oil is prevented from being supplied from the retarded angle chamber 42 to the slide groove 94. When the operating oil is supplied to the advanced angle chamber 41, a portion of that operating oil is supplied to the end portion 92*e* of the valve body 92 by means of the third passage 96. Then, as illustrated in FIG. 21B, the valve body 92 turns to the open state in which the valve body 92 is retracted from the valve recess portion 91 by the pressure of the operating oil. The open state of the valve body 92 is retained by the application of the force to the end portion 92*e*, the force being generated by the pressure of the operating oil supplied by means of the third passage 96 and biasing the valve body 92 to be retracted from the valve recess portion 91.

In the cases where the valve body 92 is in the open state as illustrated in FIG. 21B, the entrance side communication portion 97*a*, the dent portion 92*d* of the valve body 92, and the exit side communication portion 97*b* communicate with one another. Thus, the operating oil supplied to the retarded angle chamber 42 enters into the slide groove 94 through the entrance side communication portion 97*a*, moves through the dent portion 92*d*, and then exits outside of the slide groove 94 through the exit side communication portion 97*b*. Since the operating oil discharged from the slide groove 94 is supplied to the restricting recess portion 61, the restricting recess portion 61 is filled with the operating oil, which is then supplied to the stepped portion 92*c* of the valve body 92 through the exit side communication portion 97*b*. The stepped portion 92*c* is facing in the direction where the valve body 92 is inserted into the valve recess portion 91 and therefore the force for biasing the stepped portion 92*c* of the valve body 92 to be retracted from the valve recess portion 91 is generated and applied by the pressure of the operating oil supplied to the stepped portion 92*c*, thereby retaining the valve body 92 in the open state.

At this time, the operating oil is also supplied to the dent portion 92*d* of the valve body 92. Thus, the pressure of that operating oil generates the force for biasing the valve body 92 to be inserted into the valve recess portion 91. However, since the dent portion 92*d* of the valve body 92 is entirely filled with the operating oil, the pressure of that operating oil also generates the force for biasing the valve body 92 to be retracted from the valve recess portion 91, which denies the force for biasing the valve body 92 to be inserted into the valve recess portion 91. Further, a depth of the stepped portion 92*c* is greater than that of the dent portion 92*c* and thus an area receiving the pressure of the operating oil of the stepped portion 92*c* is greater than an area receiving the pressure of the operating oil of the dent portion 92*d*. Accordingly, the force for biasing the stepped portion 92*c* of the valve body 92 to be retracted from the valve recess portion 91 is generated and applied by the pressure of the operating oil supplied to the stepped portion 92*c*, thereby retaining the valve body 92 in the open state.

Figure 13:
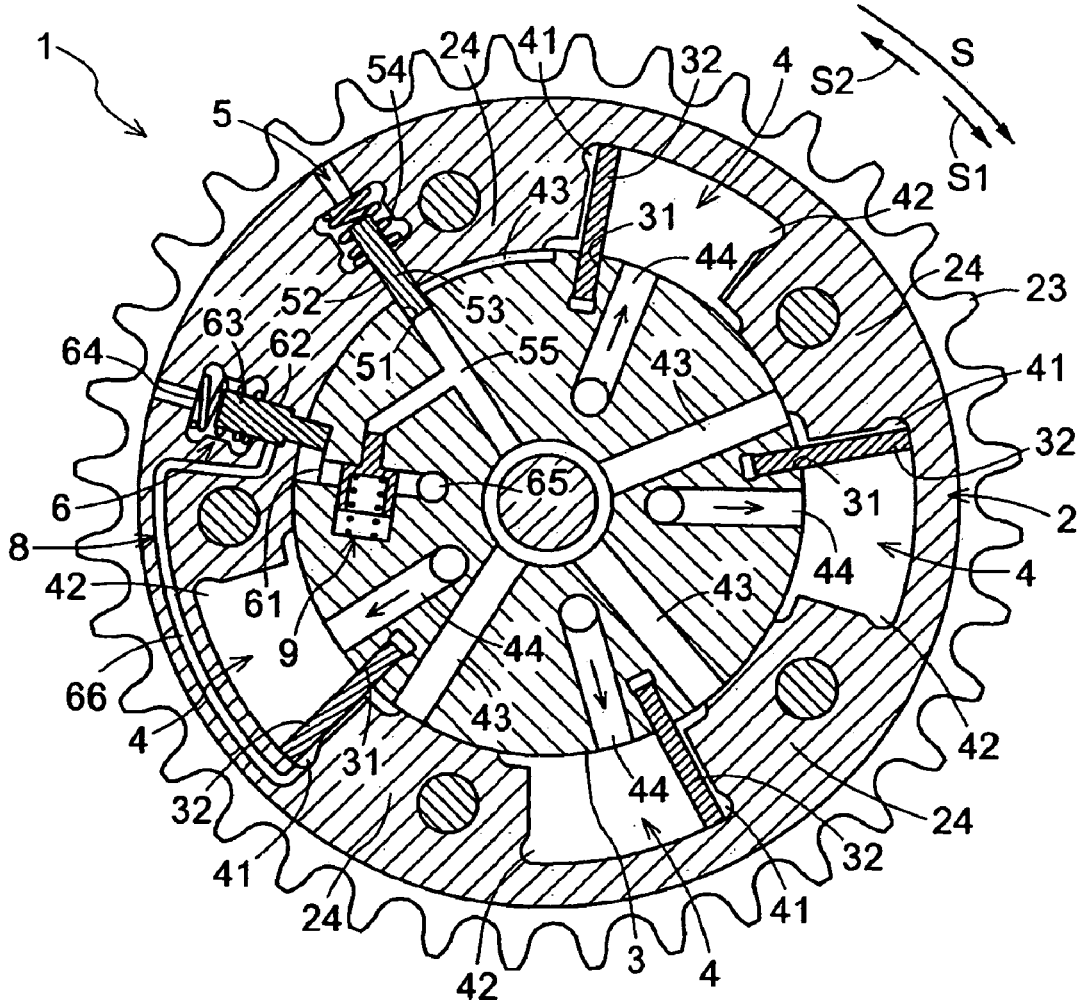
FIG. 13 is a cross-sectional view taken along the line II-II in FIG. 1 according to the third embodiment of the present invention.
Figure 22:
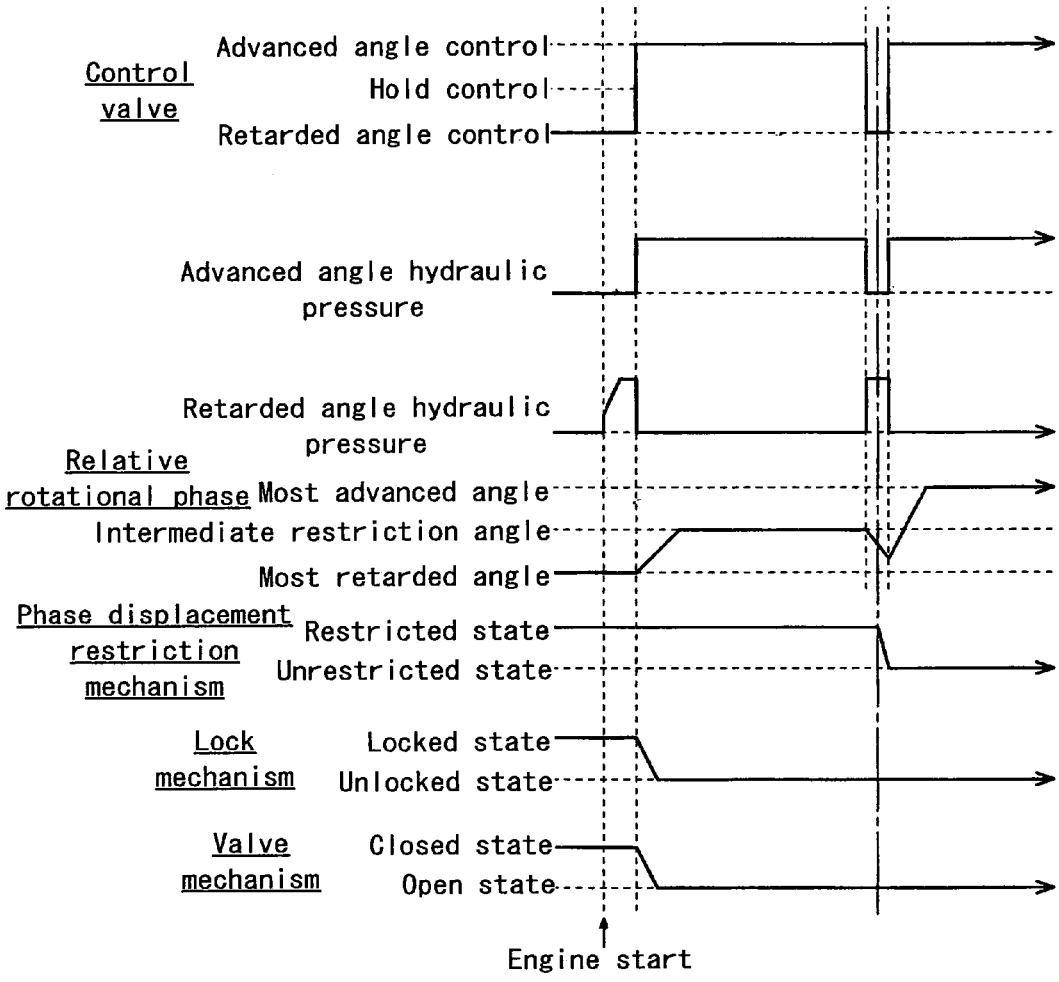
FIG. 22 is a timing chart illustrating an operation example of the valve timing control device according to the third embodiment of the present invention.

Next, an example of an operation of the valve timing control device 1 when the engine 10 starts in a state where the relative rotational phase is at the predetermined lock phase (most retarded angle phase) will be explained with reference to a timing chart shown in FIG. 22. In the cases where the engine 10 is stopped, the first pump 71 and the second pump 72 are both stopped. At this time, the relative rotational phase is at the predetermined lock phase (most retarded angle phase) as illustrated in FIG. 13. The lock mechanism 5 is in the locked state in which the lock member 53 projects to be inserted into the engaging recess portion 51 and the phase displacement restriction mechanism 6 is in the restricted state in which the insertion member 63 projects to be inserted into the restricting recess portion 61. The valve mechanism 9 is in the closed state. Then, the cranking is started to activate the engine 10 while the relative rotational phase is locked at the predetermined lock phase. When the engine is in operation, the control unit 80 brings the control valve 73 in the retarded angle control state so as to supply the operating oil from the hydraulic circuit 7 to the retarded angle passages 44 and the restricting passage 65. At this time, since the valve mechanism 9 is in the closed state, the operating oil is prevented from being supplied to the restricting recess portion 61, thereby retaining the phase displacement restriction mechanism 6 in the restricted state in which the insertion member 63 is inserted into the restricting recess portion 61. Accordingly, the retarded angle chamber 42 is filled with the operating oil while the phase displacement restriction mechanism 6 is retained in the restricted state.

Figure 14:
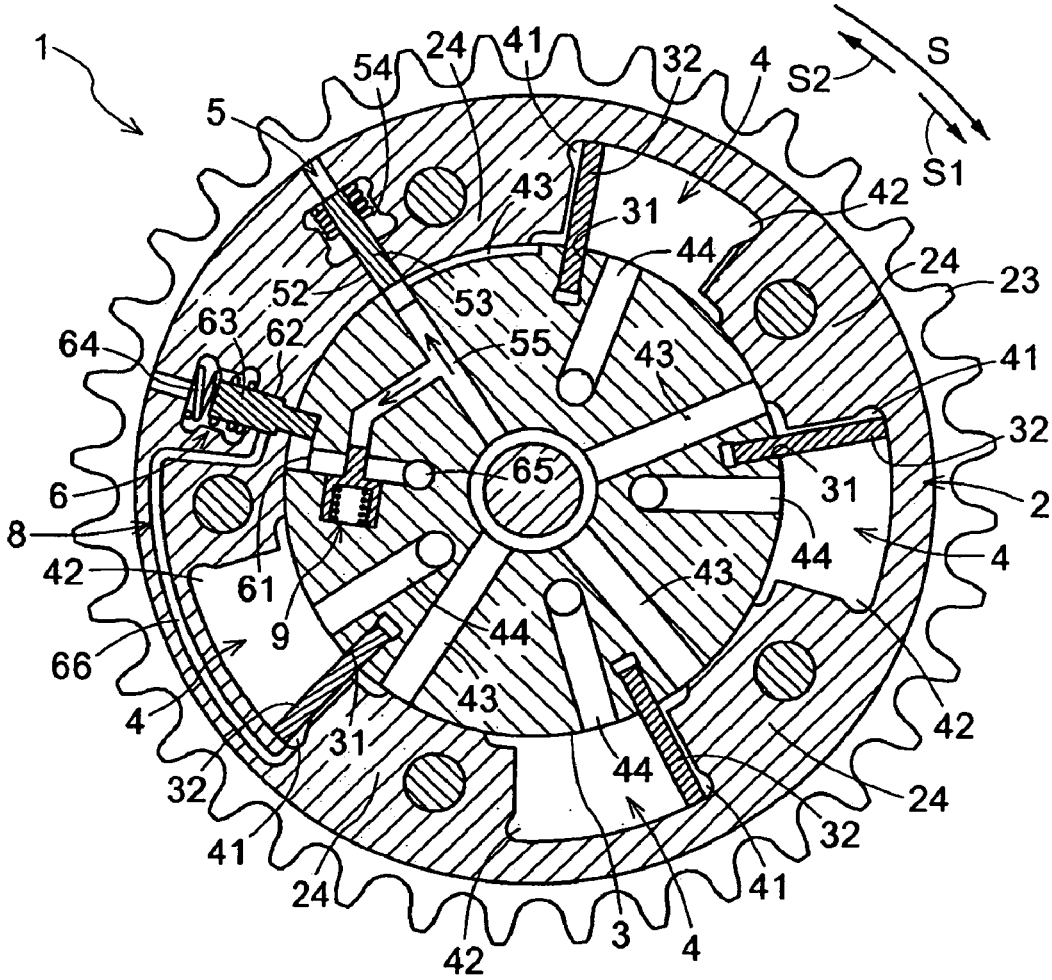
FIG. 14 is a cross-sectional view taken along the line II-II in FIG. 1 according to the third embodiment of the present invention.
Figure 15:
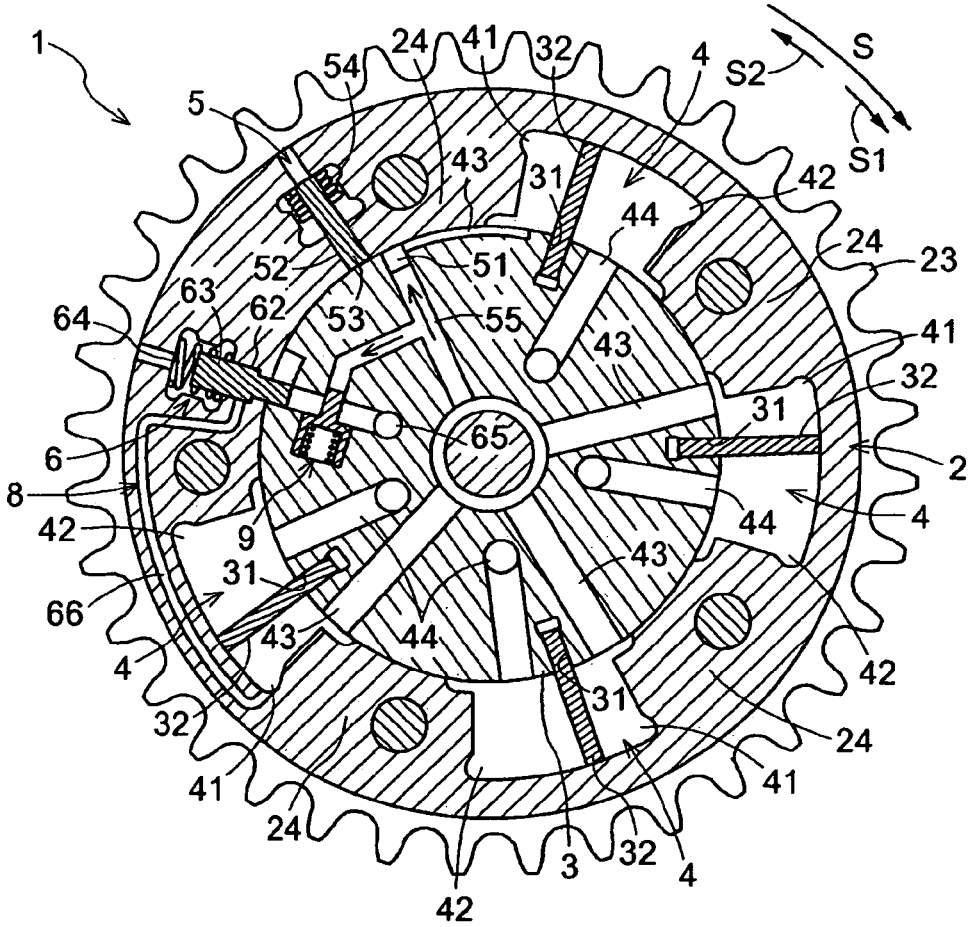
FIG. 15 is a cross-sectional view taken along the line II-II in FIG. 1 according to the third embodiment of the present invention.

Then, the control unit 80 brings the control valve 73 in the advanced angle control state so as to supply the operating oil from the hydraulic circuit 7 to the advanced angle passages 43 and the lock passage 55. Then, as illustrated in FIG. 14, the valve mechanism 9 turns to the open state and at the same time the lock mechanism 5 turns to the unlocked state in which the lock member 53 is retracted from the engaging recess portion 51, thereby displacing the relative rotational phase in the advanced angle direction S1. At this time, since the retarded angle chambers 42 are filled with the operating oil, a speed of the displacement of the relative rotational phase in the advanced angle direction S1 can be lowered. In addition, since the phase displacement restriction mechanism 6 is still in the restricted state, the side surface of the insertion member 63 is in contact with the first end surface 61*b* of the restricting portion 61 as illustrated in FIG. 15 so that the relative rotational phase is locked at the intermediate restriction phase, which is the one end of the predetermined phase displacement allowable range. At this time, the speed of the displacement of the relative rotational phase in the advanced angle direction S1 is slow, which can reduce a hitting sound occurring upon contact of the either side surface of the insertion member 63 with the either end surface 61*a* or 61*b* of the restricting recess portion 61.

When a predetermined time has elapsed, the control unit 80 brings the control valve 73 in the retarded angle control state so as to supply the operating oil from the hydraulic circuit 7 to the retarded angle passages 44 and the restriction passage 65. Then, the insertion member 63 is retracted from the restricting recess portion 61 so that the phase displacement restriction mechanism 6 turns to the unrestricted state as illustrated in FIG. 16 in which the relative rotational phase is displaceable at any positions between the most retarded angle phase as illustrated in FIG. 15 and the most advanced angle phase as illustrated in FIG. 17. After the valve mechanism 9 turns to the open state, the operating oil is supplied from the hydraulic circuit 7 to the retarded angle passages 44 and the restriction passage 65, or to the advanced angle passages 43 and the lock passage 55. Accordingly, the operating oil can be supplied to the valve body 92 of the valve mechanism 9 by means of either one of or both of the third passage 96 and the fourth passage 97.

According to the aforementioned first to third embodiments, the lock mechanism 5 and the phase displacement restriction mechanism 6 are arranged adjacent to the identical protruding portion 24, i.e. arranged opposite sides of the identical protruding portion 24. However, instead, the lock mechanism 5 and the phase displacement restriction mechanism 6 can be arranged in any positions, for example, adjacent to the different protruding portions 24.

Further, according to the aforementioned first to third embodiments, the predetermined phase displacement allowable range includes the predetermined lock phase. However, the predetermined phase displacement allowable range is not limited to the above and the lock mechanism and the phase displacement restriction mechanism 6 can be constituted in such a manner that the predetermined lock phase is out of the predetermined phase displacement allowable range.

The predetermined lock phase at which the relative rotational phase is locked by the lock mechanism 5, the intermediate restriction phase at the end of the predetermined phase displacement allowable range in which the displacement of the relative rotational phase is restricted by the phase displacement restriction mechanism 6, and the like according to the first to third embodiments are just examples and can be appropriately changed depending on the engine characteristics, the use conditions, and the like.

According to the aforementioned first to third embodiments, the lock member 53 of the lock mechanism 5 and the insertion member 63 of the phase displacement restriction mechanism 6 both project from the outer rotor 2 towards the inner rotor 3 to be inserted into the engaging recess portion 51 and the restricting recess portion 61, respectively, formed at the inner rotor 3. However, the relationship between the inner rotor 3 and the outer rotor 2 can be reversed. That is, the lock member 53 of the lock mechanism 5 and the insertion member 63 of the phase displacement restriction mechanism 6 can project from the inner rotor 3 towards the outer rotor 2 to be inserted into the engaging recess portion 51 and the restricting recess portion 61, respectively, formed at the outer rotor 2.

According to the aforementioned second embodiment, the retention mechanism 8 includes the engaging member 83 movable in the rotation direction and the radial direction of the outer rotor 2 and the inner rotor 3, and the guide surface 84*a* radially outwardly guiding the engaging member 83 so that the engaging member 83 moves close to the engaged portion 67*a*. However, the retention mechanism 8 is not limited to the above structure.

According to the aforementioned third embodiment, the retarded angle chamber 42 corresponds to one of the advanced angle chamber and the retarded angle chamber, and the advanced angle chamber 41 corresponds to the other one of the advanced angle chamber and the retarded angle chamber. However, the advanced angle chamber 41 can correspond to one of the advanced angle chamber and the retarded angle chamber and the retarded angle chamber 42 can correspond to the other one of the advanced angle chamber and the retarded angle chamber.

The aforementioned third embodiment is obtained by adding the valve mechanism 9 to the first embodiment. However, the third embodiment can be obtained by adding the valve mechanism 9 to the second embodiment.

According to the aforementioned third embodiment, the valve mechanism 9 includes the valve valve recess portion 91, the valve body 92, and the valve holding mechanism 93. However, the valve mechanism 9 is not limited to the above structure and can have any structures as long as the valve mechanism 9 is brought to the open state by the portion of the operating oil supplied to the other one of the advanced angle chamber and the retarded angle chamber, and is retained in the open state by the portion of the operating oil supplied to at least one of the advanced angle chamber and the retarded angle chamber.

According to the aforementioned embodiments, the relative rotational phase between the driving side rotational member and the driven side rotational member can be locked at the predetermined lock phase by the lock mechanism. In addition, the relative rotational phase can be locked at either end of the predetermined phase displacement allowable range by displacing the relative rotational phase in either direction in a state where the lock mechanism is in the unlocked state and the phase displacement restriction mechanism is in the restricted state in which the insertion member is inserted into the recess portion. That is, the relative rotational phase can be locked at the phase of the either end of the predetermined phase displacement allowable range in addition to the predetermined lock phase. Accordingly, at the time or immediately after the internal combustion engine starts operating, the phase at which an appropriate valve timing is obtained can be selected so as to lock the relative rotational phase at that selected phase. Then, the phase displacement restriction mechanism is brought to the unrestricted state in which the insertion member is retracted from the recess portion so that the fluid supply and discharge mechanism supplies or discharges the fluid to or from the advanced angle chamber and the retarded angle chamber, thereby displacing the relative rotational phase in the advanced angle direction or the retarded angle direction. At this time, since the retention mechanism retains the phase displacement restriction mechanism in the unrestricted state, the insertion member is prevented from being wrongly inserted into the recess portion, thereby achieving a precise movement of the relative rotational phase in the retarded angle direction or the advanced angle direction.

Further, according to the aforementioned embodiments, a portion of the fluid supplied to the advanced angle chambers is supplied by means of the first passage to the receiving portion and a pressure of which biases the insertion member to be retracted from the recess portion. In addition, a portion of the fluid supplied to the retarded angle chambers is supplied by means of the second passage to the receiving portion and a pressure of which biases the insertion member to be retracted from the recess portion. Accordingly, the insertion member is biased to be retracted from the recess portion by means of the portion of the fluid supplied to one of or both of the advanced angle cambers and the retarded angle chambers, and then that biasing force is made larger than that for inserting the insertion member into the recess portion, thereby appropriately retaining the insertion member to be retracted from the recess portion. Since the fluid supplied to the advanced angle chambers and the retarded angle chambers is used, a control valve for controlling a supply and discharge of the fluid is not required at the receiving portion, which may lead to a simple structure.

Further, according to the aforementioned embodiments, the fluid is supplied to the stepped portion of the insertion member by means of the first passage and the pressure of which biases the stepped portion to be retracted from the recess portion. In addition, the fluid is supplied to the end portion of the insertion member facing in the direction where the insertion member is inserted into the recess portion and the pressure of which biases the end portion to be retracted from the recess portion. Accordingly, the pressure of the fluid supplied by the first passage and that supplied by the second passage are separately applied to the insertion member so as to appropriately bias the insertion member to be retracted from the recess portion, which may lead to an appropriate retention of the state in which the insertion member is retracted from the recess portion.

Further, according to the aforementioned embodiments, the first passage is formed by attaching the cover member and the driving side rotational member to each other with a groove formed at one of or both of the cover member and the driving side rotational member. Accordingly, the first passage can be easily formed by using the mating surface between the cover member and the driving side rotational member. In addition, the second passage is formed easily at the driven side rotational member, which is different from a portion where the first passage is formed.

Further, according to the aforementioned second embodiment, when the insertion member is retracted from the recess portion, which leads to the unrestricted state of the phase displacement restriction mechanism, the engaging member engages with the engaged portion of the insertion member, thereby retaining the phase displacement restriction mechanism in the unrestricted state. The phase displacement restriction mechanism is appropriately retained in the unrestricted state by the engagement between the engaging member and the engaged portion.

Further, according to the aforementioned second embodiment, the centrifugal force generated by the rotation of the driving side rotational member and the driven side rotational member causes the engaging member to move in a radially outward direction. At this time, the engaging member is guided by the guide member so as to move close to the engaged portion, thereby retaining the engagement between the engaging member and the engaged portion. In addition, when the centrifugal force decreases, the engaging member is guided by the guide member and then movable in a direction to be away from the engaged portion so as to cancel the retention of the state in which the insertion member is retracted from the recess portion. Accordingly, the retention mechanism can be constituted by using the centrifugal force generated upon rotation of the driving side rotational member and the driven side rotational member, thereby achieving the simple structure.

Further, according to the aforementioned third embodiment, by the supply of the fluid to the retarded angle chambers, the portion of the fluid supplied by means of the second passage to the retarded angle chamber is supplied to the recess portion and the pressure of which causes the insertion member to be retracted from the recess portion so as to achieve the unrestricted state of the phase displacement restriction mechanism. Since the second passage includes the valve mechanism, the valve mechanism should turn to the open state first for the purposes of bringing the phase displacement restriction mechanism to the unrestricted state. In the case of bringing the phase displacement restriction mechanism to the unrestricted state, first, the portion of the fluid supplied to the advanced angle chambers is supplied to the valve mechanism so that the valve mechanism turns to the open state. Then, the fluid is also supplied to the retarded angle chambers. When the valve mechanism is brought to the open state, that open state is retained by the supply of the portion of the fluid, which is supplied to at least one of the advanced angle chambers and the retarded angle chambers, to the valve mechanism. Accordingly, the second passage is retained in the open state, i.e. the fluid is thereby supplied, during the operation of the valve timing control device afterwards.

The valve mechanism that opens or closes the second passage is retained in the closed state when the fluid is only supplied to one of the advanced angle chambers and the retarded angle chambers. Thus, the fluid is supplied to one of the advanced angle chambers and the retarded angle chambers while the valve mechanism is retained in the closed state so that one of the advanced angle chambers and the retarded angle chambers are filled with the fluid. That is, in the case that one of the advanced angle chamber and the retarded angle chamber corresponds to the retarded angle chamber, the retarded angle chamber can be filled with the fluid while the valve mechanisms is in the closed state and the phase displacement restriction mechanism is in the restricted state. Accordingly, since the fluid is supplied to one of the advanced angle chambers and the retarded angle chambers that are then filled with the fluid, an occurrence of noise can be prevented, which may be generated when the fluid is supplied to the other one of the advanced angle chambers and the retarded angle chambers and then the relative rotational phase is restricted at either end of the predetermined phase displacement allowable range.

More precisely, the fluid is supplied to the other one of the advanced angle chambers and the retarded angle chambers so that the relative rotation phase is locked at either end of the predetermined phase displacement allowable range by the contact between the insertion member and the recess portion. At this time, the sound of hitting between the insertion member and the recess portion may be generated. The hitting sound is larger when a speed of the displacement of the relative rotational phase is faster. Then, the fluid is supplied to the other one of the advanced angle chambers and the retarded angle chambers that are then filled with the fluid before the relative rotational phase is locked at either end of the predetermined phase displacement allowable range. Accordingly, because the fluid with which one of the advanced angle chambers and the retarded angle chambers are filled functions as a resistance, the speed when the relative rotational phase is locked at either end of the predetermined phase displacement allowable range can be lowered. The sound of hitting between the insertion member and the recess portion can be reduced and thus the noise occurrence can be prevented.

According to the aforementioned third embodiment, when the phase displacement restriction mechanism is brought to the unrestricted state, first, the portion of the fluid supplied to the other one of the advanced angle chambers and the retarded angle chambers is supplied to the recess portion and the pressure of which causes the valve body to be retracted from the recess portion so as to achieve the open state. Then, the fluid is supplied to one of the advanced angle chambers and the retarded angle chambers. When the valve body turns to the open state, that open state is retained by the valve holding mechanism and thus the second passage can be retained in the open state during the operation of the valve timing control device afterwards.

The valve body is retained in the closed state when the fluid is only supplied to one of the advanced angle chambers and the retarded angle chambers. Thus, the fluid is supplied to one of the advanced angle chambers and the retarded angle chambers while the valve body is retained in the closed state so that one of the advanced angle chambers and the retarded angle chambers are filled with the fluid. Therefore, the fluid is supplied to the other one of the advanced angle chambers and the retarded angle chambers that are then filled with the fluid before the relative rotational phase is locked at either end of the predetermined phase displacement allowable range. The noise occurrence can be prevented accordingly.

Further, according to the aforementioned third embodiment, the fluid is supplied by means of the third passage to the end portion of the valve body facing in the direction in which the valve body is inserted into the recess portion and the pressure of which biases the end portion of the valve body to be retracted from the recess portion. In addition, the fluid is supplied by means of the fourth passage to the stepped portion of the valve body and the pressure of which biases the stepped portion of the valve body to be retracted from the recess portion. Accordingly, the pressure of the fluid supplied by the third passage and that supplied by the fourth passage are separately applied to the valve body so as to appropriately bias the. valve body to be retracted from the recess portion, which lease to an appropriate retention of the state in which the valve body is retracted from the recess portion.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control device comprising:

a driving side rotational member synchronously rotatable with a crankshaft of an internal combustion engine;

a driven side rotational member arranged coaxially with the driving side rotational member and synchronously rotatable with a camshaft that controls an opening and closing operation of valves of the internal combustion engine;

a retarded angle chamber defined by the driving side rotational member and the driven side rotational member and displacing a relative rotational phase of the driven side rotational member to the driving side rotational member in a retarded angle direction by a supply of a fluid to the retarded angle chamber;

an advanced angle chamber defined by the driving side rotational member and the driven side rotational member and displacing the relative rotational phase in an advanced angle direction by the supply of the fluid to the advanced angle chamber;

a fluid supply and discharge mechanism for supplying the fluid to the advanced angle chamber and the retarded angle chamber and for discharging the fluid from the advanced angle chamber and the retarded angle chamber;

a lock mechanism for locking the relative rotational phase at a predetermined lock phase;

a phase displacement restriction mechanism operable separately from the lock mechanism and switching the relative rotational phase between a restricted state in which a displacement of the relative rotational phase is restricted within a predetermined phase displacement allowable range and an unrestricted state in which the restricted state is released;

the phase displacement restriction mechanism including a recess portion and an insertion member inserted into the recess portion so as to achieve the restricted state and retraced from the recess portion so as to achieve the unrestricted state, the recess portion provided at one of the driving side rotational member and the driven side rotational member, the insertion member provided at the other one of the driving side rotational member and the driven side rotational member, the insertion member biased to be inserted into the recess portion; and a retention mechanism for retaining the phase displacement restriction mechanism in the unrestricted state in which the insertion member is retracted from the recess portion, wherein the retention mechanism includes a first passage by means of which a portion of the fluid supplied to the advanced angle chamber is supplied to a receiving portion within which the insertion member is slidably accommodated, and a second passage by means of which a portion of the fluid supplied to the retarded angle chamber is supplied to the receiving portion.

2. A valve timing control device according to claim 1, wherein the fluid is supplied by means of the first passage to a stepped portion formed at a middle portion of the insertion member in an inserting and retracting direction thereof, and is supplied by means of the second passage to an end portion of the insertion member facing in a direction in which the insertion member is inserted into the recess portion.

3. A valve timing control device according to claim 1, wherein the first passage is formed at a mating surface between a cover member that covers the advanced angle chamber and the retarded angle chamber and the driving side rotational member, and the second passage is formed at the driven side rotational member.

4. A valve timing control device according to claim 1, wherein the first passage is formed at a cover member that covers the advanced angle chamber and the retarded angle chamber, and the second passage is formed at the driven side rotational member.

5. A valve timing control device comprising:

a driving side rotational member synchronously rotatable with a crankshaft of an internal combustion engine;

a driven side rotational member arranged coaxially with the driving side rotational member and synchronously rotatable with a camshaft that controls an opening and closing operation of valves of the internal combustion engine;

a retarded angle chamber defined by the driving side rotational member and the driven side rotational member and displacing a relative rotational chase of the driven side rotational member to the driving side rotational member in a retarded angle direction by a supply of a fluid to the retarded angle chamber;

an advanced angle chamber defined by the driving side rotational member and the driven side rotational member and displacing the relative rotational phase in an advanced angle direction by the supply of the fluid to the advanced angle chamber;

a fluid supply and discharge mechanism for supplying the fluid to the advanced angle chamber and the retarded angle chamber and for discharging the fluid from the advanced angle chamber and the retarded angle chamber;

a lock mechanism for locking the relative rotational phase ata predetermined lock phase;

a phase displacement restriction mechanism operable separately from the lock mechanism and switching the relative rotational phase between a restricted state in which a displacement of the relative rotational phase is restricted within a predetermined phase displacement allowable range and an unrestricted state in which the restricted state is released;

the phase displacement restriction mechanism including a recess portion and an insertion member inserted into the recess portion so as to achieve the restricted state and retraced from the recess portion so as to achieve the unrestricted state, the recess portion provided at one of the driving side rotational member and the driven side rotational member, the insertion member provided at the other one of the driving side rotational member and the driven side rotational member, the insertion member biased to be inserted into the recess portion; and a retention mechanism for retaining the phase displacement restriction mechanism in the unrestricted state in which the insertion member is retracted from the recess portion, wherein the phase displacement restriction mechanism includes a second passage for supplying the fluid supplied to one of the advanced angle chamber and the retarded angle chamber to the recess portion, and the second passage includes a valve mechanism that turns to an open state by receiving a portion of the fluid supplied to the other one of the advanced angle chamber and the retarded angle chamber and retains the open state by receiving a portion of the fluid supplied to one of the advanced angle chamber and the retarded angle chamber.

6. A valve timing control device comprising:

a driving side rotational member synchronously rotatable with a crankshaft of an internal combustion engine;

a driven side rotational member arranged coaxially with the driving side rotational member and synchronously rotatable with a camshaft that controls an opening and closing operation of valves of the internal combustion engine;

a retarded angle chamber defined by the driving side rotational member and the driven side rotational member and displacing a relative rotational phase of the driven side rotational member to the driving side rotational member in a retarded angle direction by a supply of a fluid to the retarded angle chamber;

an advanced angle chamber defined by the driving side rotational member and the driven side rotational member and displacing the relative rotational phase in an advanced angle direction by the suPPly of the fluid to the advanced angle chamber;

a fluid supply and discharge mechanism for supplying the fluid to the advanced angle chamber and the retarded angle chamber and for discharging the fluid from the advanced angle chamber and the retarded angle chamber;

a lock mechanism for locking the relative rotational phase at a predetermined lock phase;

a phase displacement restriction mechanism operable separately from the lock mechanism and switching the relative rotational phase between a restricted state in which a displacement of the relative rotational phase is restricted within a predetermined phase displacement allowable range and an unrestricted state in which the restricted state is released;

the phase displacement restriction mechanism including a recess portion and an insertion member inserted into the recess portion so as to achieve the restricted state and retraced from the recess portion so as to achieve the unrestricted state, the recess portion provided at one of the driving side rotational member and the driven side rotational member, the insertion member provided at the other one of the driving side rotational member and the driven side rotational member, the insertion member biased to be inserted into the recess portion; and a retention mechanism for retaining the phase displacement restriction mechanism in the unrestricted state in which the insertion member is retracted from the recess portion, wherein the phase displacement restriction mechanism includes a second passage for supplying the fluid supplied to one of the advanced angle chamber and the retarded angle chamber to the recess portion, and the second passage includes a valve mechanism including a recess portion to which a portion of the fluid supplied to the other one of the advanced angle chamber and the retarded angle chamber is supplied, a valve body switched between an open state in which the valve body is inserted into the recess portion and a closed state in which the valve body is retracted from the recess portion, and biased to be inserted into the recess portion, and a valve holding mechanism for retaining the valve body in the closed state by receiving a portion of the fluid supplied to one of the advanced angle chamber and the retarded angle chamber.

7. A valve timing control device according to claim 6, wherein the valve holding mechanism includes a third passage by means of which a portion of the fluid supplied to the other one of the advanced angle chamber and the retarded angle chamber is supplied to an end portion formed at the valve body in a direction in which the valve body is inserted into the recess portion, and a fourth passage by means of which a portion of the fluid supplied to one of the advanced angle chamber and the retarded angle chamber is supplied to a stepped portion formed at a middle portion of the valve body in an inserting and retracting direction thereof.

* * * * *